US011081048B2

(12) United States Patent
Toyotaka

(10) Patent No.: US 11,081,048 B2
(45) Date of Patent: Aug. 3, 2021

(54) DISPLAY DEVICE

(71) Applicant: Semiconductor Energy Laboratory Co., Ltd., Atsugi (JP)

(72) Inventor: Kouhei Toyotaka, Kanagawa (JP)

(73) Assignee: Semiconductor Energy Laboratory Co., Ltd., Atsugi (JP)

( * ) Notice: Subject to any disclaimer, the term of this patent is extended or adjusted under 35 U.S.C. 154(b) by 0 days.

(21) Appl. No.: 16/539,019

(22) Filed: Aug. 13, 2019

(65) Prior Publication Data

US 2019/0371241 A1 Dec. 5, 2019

Related U.S. Application Data

(63) Continuation of application No. 15/869,724, filed on Jan. 12, 2018, now Pat. No. 10,395,593, which is a (Continued)

(30) Foreign Application Priority Data

May 13, 2011 (JP) ..... JP2011-108318

(51) Int. Cl.
*G09G 3/3233* (2016.01)
*G09G 3/20* (2006.01)

(52) U.S. Cl.
CPC ..... *G09G 3/3233* (2013.01); *G09G 3/20* (2013.01); *G09G 2300/0809* (2013.01); (Continued)

(58) Field of Classification Search
CPC ..... G09G 3/3233; G09G 3/20; G09G 2310/0286; G09G 2310/08; (Continued)

(56) References Cited

U.S. PATENT DOCUMENTS 5,528,032 A 6/1996 Uchiyama
5,889,291 A 3/1999 Koyama et al.
(Continued)

FOREIGN PATENT DOCUMENTS

CN 001388501 A 1/2003
CN 001702711 A 11/2005
(Continued)

OTHER PUBLICATIONS

International Search Report (Application No. PCT/JP2012/002618) dated Jul. 17, 2012.
(Continued)

*Primary Examiner* — Grant Sitta
(74) *Attorney, Agent, or Firm* — Fish & Richardson P.C.

(57) ABSTRACT

A display device includes a plurality of pulse output circuits each of which outputs signals to one of the two kinds of scan lines and a plurality of inverted pulse output circuits each of which outputs, to the other of the two kinds of scan lines, inverted or substantially inverted signals of the signals output from the pulse output circuits. Each of the plurality of inverted pulse output circuits operates with at least two kinds of signals used for the operation of the plurality of pulse output circuits. Thus, through current generated in the inverted pulse output circuits can be reduced.

4 Claims, 14 Drawing Sheets

Related U.S. Application Data continuation of application No. 15/221,662, filed on Jul. 28, 2016, now Pat. No. 9,886,905, which is a continuation of application No. 13/467,092, filed on May 9, 2012, now Pat. No. 9,412,291.

(52) U.S. Cl.
CPC ..... *G09G 2310/0267* (2013.01); *G09G 2310/0286* (2013.01); *G09G 2310/08* (2013.01); *G09G 2330/021* (2013.01)

(58) Field of Classification Search
CPC ..... G09G 2300/0809; G09G 2330/021; G09G 2310/0267
See application file for complete search history.

(56) References Cited

U.S. PATENT DOCUMENTS 6,229,506 B1 * 5/2001 Dawson ..... G09G 3/3233 345/82
6,456,267 B1 9/2002 Sato et al.
6,777,716 B1 * 8/2004 Yamazaki ..... H01L 27/1214 257/88
6,859,193 B1 2/2005 Yumoto
6,928,136 B2 8/2005 Nagao et al.
7,151,278 B2 12/2006 Nagao et al.
7,193,591 B2 3/2007 Yumoto
7,365,713 B2 4/2008 Kimura
7,379,039 B2 5/2008 Yumoto
7,388,564 B2 6/2008 Yumoto
7,394,102 B2 7/2008 Nagao et al.
7,429,985 B2 9/2008 Kimura et al.
7,499,042 B2 3/2009 Shirasaki et al.
7,511,709 B2 3/2009 Koyama et al.
7,518,579 B2 4/2009 Kwak
7,528,808 B2 5/2009 Tam
7,545,174 B2 6/2009 Senda et al.
7,605,810 B2 10/2009 Shin
7,679,585 B2 * 3/2010 Kimura ..... G09G 3/3233 345/76
7,687,808 B2 * 3/2010 Umezaki ..... H01L 27/1222 257/72
7,710,366 B2 5/2010 Lee et al.
7,710,379 B2 5/2010 Iwabuchi et al.
7,714,817 B2 5/2010 Park et al.
7,724,232 B2 * 5/2010 Moon ..... G09G 3/20 345/100
7,750,873 B2 7/2010 Kim
7,782,276 B2 8/2010 Shin
7,852,301 B2 12/2010 Chiou et al.
7,928,938 B2 * 4/2011 Osame ..... G09G 3/2022 345/82
7,932,888 B2 * 4/2011 Miyake ..... G11C 19/00 345/100
7,948,466 B2 5/2011 Lee
8,031,141 B2 10/2011 Shin
8,035,109 B2 10/2011 Kimura
8,040,302 B2 10/2011 Shin
8,054,279 B2 11/2011 Umezaki et al.
8,085,235 B2 12/2011 Jeon et al.
8,314,514 B2 * 11/2012 Kimura ..... H01L 27/1255 307/113
8,330,492 B2 12/2012 Umezaki
8,384,702 B2 2/2013 Jinta
8,487,841 B2 7/2013 Kimura et al.
8,743,044 B2 6/2014 Umezaki et al.
8,773,345 B2 7/2014 Lebrun et al.
8,803,781 B2 8/2014 Kimura et al.
8,823,609 B2 9/2014 Chung
8,830,149 B2 9/2014 Yamamoto et al.
8,896,506 B2 11/2014 Kimura et al.
8,902,145 B2 12/2014 Umezaki et al.
8,922,464 B2 * 12/2014 Inoue ..... G09G 3/3233 345/76
9,012,918 B2 4/2015 Yamazaki et al.
9,076,394 B2 7/2015 Saitoh
9,208,717 B2 12/2015 Kimura et al.
9,412,291 B2 * 8/2016 Toyotaka ..... G09G 3/20
9,536,903 B2 1/2017 Umezaki et al.
9,805,641 B2 10/2017 Koyama
9,830,853 B2 11/2017 Kimura et al.
9,842,861 B2 12/2017 Umezaki et al.
9,886,905 B2 * 2/2018 Toyotaka ..... G09G 3/20
10,297,618 B2 5/2019 Umezaki et al.
10,395,593 B2 * 8/2019 Toyotaka ..... G09G 3/20
2002/0190326 A1 12/2002 Nagao et al.
2003/0117352 A1 * 6/2003 Kimura ..... H01L 27/3265 345/87
2003/0128180 A1 7/2003 Kim et al.
2003/0174118 A1 9/2003 Sato et al.
2004/0246241 A1 * 12/2004 Sato ..... G09G 3/3283 345/204
2005/0220262 A1 10/2005 Moon
2005/0220263 A1 10/2005 Moon
2005/0264496 A1 12/2005 Shin
2006/0066532 A1 3/2006 Jeong
2006/0145964 A1 7/2006 Park et al.
2007/0085847 A1 * 4/2007 Shishido ..... G09G 3/3225 345/204
2007/0124633 A1 5/2007 Kim
2007/0240024 A1 10/2007 Shin
2008/0036711 A1 2/2008 Kwak et al.
2008/0062112 A1 3/2008 Umezaki
2008/0117157 A1 5/2008 Hwang et al.
2008/0174589 A1 7/2008 Nagao et al.
2008/0238835 A1 10/2008 Asano et al.
2009/0256794 A1 10/2009 Jang et al.
2009/0273591 A1 11/2009 Jinta
2009/0303169 A1 * 12/2009 Tanikame ..... G09G 3/3266 345/100
2010/0245304 A1 9/2010 Umezaki
2010/0283715 A1 11/2010 Kretz et al.
2010/0328299 A1 12/2010 Yamazaki et al.
2011/0043511 A1 2/2011 Hsueh et al.
2011/0063262 A1 3/2011 Umezaki et al.
2011/0080395 A1 4/2011 Chung
2011/0193622 A1 8/2011 Miyake
2011/0292088 A1 12/2011 Toyotaka et al.
2011/0310133 A1 12/2011 Koyama et al.
2012/0001878 A1 1/2012 Kurokawa et al.
2012/0002132 A1 1/2012 Yamazaki et al.
2012/0019567 A1 1/2012 Yamazaki et al.
2012/0025193 A1 2/2012 Kimura
2012/0162283 A1 6/2012 Miyairi et al.
2013/0107154 A1 5/2013 Umezaki
2013/0222352 A1 8/2013 Jeong
2014/0334596 A1 11/2014 Kimura et al.
2015/0055050 A1 2/2015 Umezaki
2015/0214379 A1 7/2015 Yamazaki et al.
2019/0280014 A1 9/2019 Umezaki et al.

FOREIGN PATENT DOCUMENTS

CN 101076846 A 11/2007
CN 101083139 A 12/2007
CN 100378788 C 4/2008
CN 101276541 A 10/2008
EP 1580722 A 9/2005
EP 1600924 A 11/2005
EP 1764774 A 3/2007
EP 1843317 A 10/2007
EP 1906414 A 4/2008
EP 3223283 A 9/2017
JP 06-275697 A 9/1994
JP 2003-101394 A 4/2003
JP 2003-202833 A 7/2003
JP 2005-301290 A 10/2005
JP 2005-331959 A 12/2005
JP 2005-338837 A 12/2005
JP 2006-011251 A 1/2006
JP 2006-106786 A 4/2006
JP 2007-086727 A 4/2007

(56) References Cited

FOREIGN PATENT DOCUMENTS

| | | | |
|---|---|---|---|
| JP | 2007-279667 | A | 10/2007 |
| JP | 2008-089915 | A | 4/2008 |
| JP | 2008-122939 | A | 5/2008 |
| JP | 2008-250093 | A | 10/2008 |
| JP | 2009-004757 | A | 1/2009 |
| JP | 2010-244067 | A | 10/2010 |
| JP | 2011-076078 | A | 4/2011 |
| JP | 2011-085918 | A | 4/2011 |
| JP | 5985878 | | 9/2016 |
| KR | 2002-0093557 | A | 12/2002 |
| KR | 2005-0113683 | A | 12/2005 |
| KR | 10-0805608 | | 2/2008 |
| KR | 2008-0089206 | A | 10/2008 |
| KR | 2011-0037644 | A | 4/2011 |
| TW | 200917198 | | 4/2009 |
| TW | 201021416 | | 6/2010 |
| TW | 201108416 | | 3/2011 |
| TW | 201112203 | | 4/2011 |
| WO | WO-2005/069260 | | 7/2005 |
| WO | WO-2012/157186 | | 11/2012 |

OTHER PUBLICATIONS

Written Opinion (Application No. PCT/JP2012/002618) dated Jul. 17, 2012.

Chinese Office Action (Application No. 201280023347.7) dated May 28, 2015.

Taiwanese Office Action (Application No. 101116350) dated Apr. 21, 2016.

Taiwanese Office Action (Application No. 101116350) dated Dec. 21, 2016.

Chinese Office Action (Application No. 201710257275.7) dated Mar. 23, 2020.

German Office Action (Application No. 112012002065.0) dated May 26, 2021.

* cited by examiner

DISPLAY DEVICE

CROSS-REFERENCE TO RELATED APPLICATIONS

This application is a continuation of U.S. application Ser. No. 15/869,724, filed Jan. 12, 2018, now allowed, which is a continuation of U.S. application Ser. No. 15/221,662, filed Jul. 28, 2016, now U.S. Pat. No. 9,886,905, which is a continuation of U.S. application Ser. No. 13/467,092, filed May 9, 2012, now U.S. Pat. No. 9,412,291, which claims the benefit of a foreign priority application filed in Japan as Serial No. 2011-108318 on May 13, 2011, all of which are incorporated by reference.

TECHNICAL FIELD

The present invention relates to a display device, particularly to a display device including a shift register in which transistors are either n-channel transistors or p-channel transistors (transistors of only one conductivity type).

BACKGROUND ART

Known display devices are active matrix display devices in which a plurality of pixels arranged in matrix include the respective switches. Each pixel displays an image in accordance with a desired potential (image signal) input through the switch.

Active matrix display devices require a circuit (scan line driver circuit) that controls switching of the switches provided in the pixels by controlling potentials of scan lines. A general scan line driver circuit includes an n-channel transistor and a p-channel transistor in combination, but a scan line driver circuit can also be formed using either n-channel transistors or p-channel transistors. Note that the former scan line driver circuit can have lower power consumption than the latter scan line driver circuit. On the other hand, the latter scan line driver circuit can be formed through a smaller number of manufacturing steps than the former scan line driver circuit.

When the scan line driver circuit is formed using either n-channel transistors or p-channel transistors, a potential output to a scan line changes from a power supply potential output to the scan line driver circuit. Specifically, when the scan line driver circuit is formed using only n-channel transistors, at least one n-channel transistor is provided between the scan line and a wiring for supplying a high power supply potential to the scan line driver circuit. Accordingly, a high potential that can be output to the scan line is decreased from the high power supply potential by the threshold voltage of the at least one n-channel transistor. In a similar manner, when the scan line driver circuit is formed using only p-channel transistors, a low potential that can be output to the scan line is increased from a low power supply potential supplied to the scan line driver circuit.

In response to the above problem, it has been proposed to provide a scan line driver circuit which is formed using either n-channel transistors or p-channel transistors and which can output, to a scan line, a power supply potential supplied to the scan line driver circuit, without a change.

For example, a scan line driver circuit disclosed in Patent Document 1 includes an n-channel transistor that controls electrical connection between scan lines and clock signals alternating between a high power supply potential and a low power supply potential at a constant frequency. When the high power supply potential is input to a drain of the n-channel transistor, a potential of a gate thereof can be increased by using capacitive coupling between the gate and a source thereof. Thus, in the scan line driver circuit disclosed in Patent Document 1, the same or substantially the same potential as the high power supply potential can be output from the source of the n-channel transistor to the scan lines.

The number of the switches provided in each pixel arranged in the active matrix display device is not limited to one. Some display devices include a plurality of switches in each pixel and control the respective switching separately to display an image. For example, Patent Document 2 discloses a display device including two kinds of transistors (p-channel transistor and n-channel transistor) in each pixel and the switching of the transistors are controlled separately by different scan lines. In order to control potentials of the separately provided two kinds of scan lines, two kinds of scan line driver circuits (scan line driver circuit A and scan line driver circuit B) are further provided. In the display device disclosed in Patent Document 2, the separately provided scan line driver circuits output, to the scan lines, signals having substantially opposite phases.

REFERENCE

Patent Documents

[Patent Document 1] Japanese Published Patent Application No. 2008-122939

[Patent Document 2] Japanese Published Patent Application No. 2006-106786

DISCLOSURE OF INVENTION

As disclosed in Patent Document 2, there also exists a display device in which a scan line driver circuit outputs, to one of two kinds of scan lines, inverted or substantially inverted signals of signals output to the other of the two kinds of scan lines. Such a scan line driver circuit is formed using either n-channel transistors or p-channel transistors. For example, the scan line driver circuit disclosed in Patent Document 1, which outputs signals to the scan lines, may output the signals to one of the two kinds of scan lines and to an inverter, and the inverter may output signals to the other of the two kinds of scan lines.

Note that in the case where the inverter is formed using either n-channel transistors or p-channel transistors, a large amount of through current is generated, which directly leads to high power consumption of the display device.

From the above, an object of one embodiment of the invention is to reduce power consumption of a display device including a scan line driver circuit which is formed using either n-channel transistors or p-channel transistors when the scan line driver circuit outputs, to one of two kinds of scan lines, inverted or substantially inverted signals of signals output to the other of the two kinds of scan lines.

The display device according to one embodiment of the invention includes a plurality of pulse output circuits each of which outputs signals to one of two kinds of scan lines and a plurality of inverted pulse output circuits each of which outputs, to the other of the two kinds of scan lines, an inverted or substantially inverted signal of the signal output from the each of the pulse output circuits. Each of the plurality of inverted pulse output circuits operates with signals used for the operation of the plurality of pulse output circuits.

Specifically, one embodiment of the invention is a display device including a plurality of pixels arranged in m rows and n columns (m and n are natural numbers larger than or equal to 4); first to m-th scan lines each one of which is electrically connected to the n pixels arranged in a corresponding one of the first to m-th rows; first to m-th inverted scan lines each one of which is electrically connected to the n pixels arranged in the corresponding one of the first to m-th rows; and a shift register which is electrically connected to the first to m-th scan lines and the first to m-th inverted scan lines. The pixels arranged in the k-th row (k is a natural number smaller than or equal to m) each includes a first switch which is on by an input of a selection signal to the k-th scan line, and a second switch which is on by an input of a selection signal to the k-th inverted scan line. Further, the shift register includes first to m-th pulse output circuits and first to m-th inverted pulse output circuits. The s-th (s is a natural number smaller than or equal to (m−2)) pulse output circuit, to which a start pulse is input (only when s is 1) or a shift pulse output from the (s−1)-th pulse output circuit is input, from which a selection signal is output to the s-th scan line, and from which a shift pulse is output to the (s+1)-th pulse output circuit, includes a first transistor which is on in a first period from a start of an input of the start pulse or the shift pulse output from the (s−1)-th pulse output circuit until a shift period ends, and outputs, from a source of the first transistor, a same or substantially same potential as a potential of a first clock signal input to a drain of the first transistor, by using capacitive coupling between a gate and the source of the first transistor in the first period. The (s+1)-th pulse output circuit, to which a shift pulse output from the s-th pulse output circuit is input, from which a selection signal is output to the (s+1)-th scan line, and from which a shift pulse is output to the (s+2)-th pulse output circuit, includes a second transistor which is on in a second period from a start of an input of the shift pulse output from the s-th pulse output circuit until the shift period ends, and outputs, from a source of the second transistor, a same or substantially same potential as a potential of a second clock signal input to a drain of the second transistor, by using capacitive coupling between a gate and the source of the second transistor in the second period. The s-th pulse output circuit, to which a shift pulse output from the s-th pulse output circuit is input, to which the second clock signal is input, and from which a selection signal is output to the s-th inverted scan line, includes a third transistor which is off in a third period from a start of an input of the shift pulse output from the s-th pulse output circuit until a potential of the second clock signal changes, and outputs, from a source of the third transistor, a selection signal to the s-th inverted scan line after the third period.

Another embodiment of the invention is a display device in which the second clock signal input to the s-th inverted pulse output circuit is replaced by a shift pulse output from the (s+1)-th pulse output circuit in the above display device.

In the display device according to one embodiment of the invention, the operation of the inverted pulse output circuits is controlled by at least two kinds of signals. Thus, through current generated in the inverted pulse output circuits can be reduced. Further, signals used for the operation of the plurality of pulse output circuits are used as the two kinds of signals. That is, the inverted pulse output circuits can operate without generating a signal additionally.

BEST MODE FOR CARRYING OUT THE INVENTION

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the invention. Therefore, the invention should not be limited to the descriptions of the embodiments below.

First, a configuration example of a display device according to one embodiment of the invention is described with reference to FIG. 1, FIGS. 2A to 2D, FIGS. 3A to 3D, and FIGS. 4A and 4B.

[Configuration Example of a Display Device]

Figure 1:
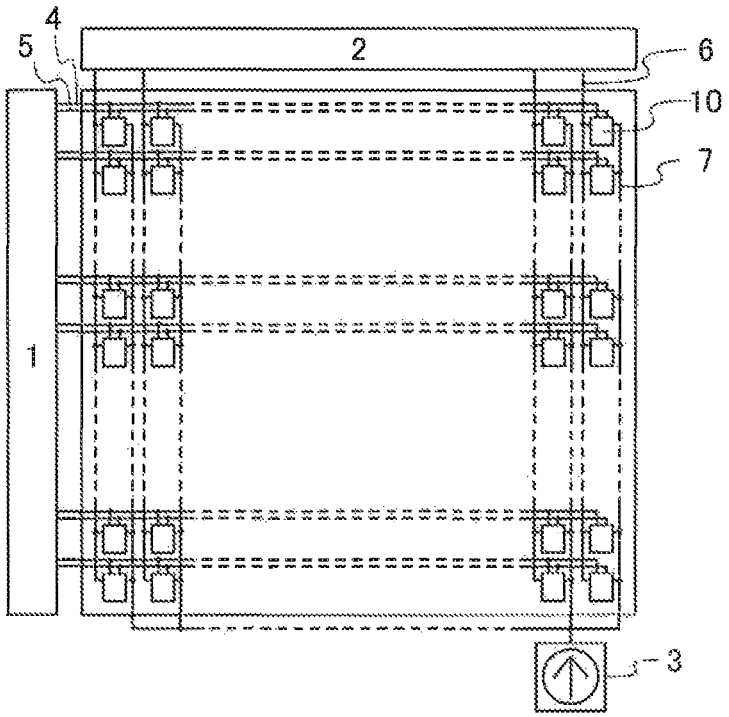
FIG. 1 illustrates a configuration example of a display device.

FIG. 1 illustrates a configuration example of a display device. The display device in FIG. 1 includes a plurality of pixels 10 arranged in m rows and n columns, a scan line driver circuit 1, a signal line driver circuit 2, a current source 3, and m scan lines 4 and m inverted scan lines 5 each of which is electrically connected to any one row of the pixels 10 and whose potentials are controlled by the scan line driver circuit 1, n signal lines 6 each of which is electrically connected to any one column of the pixels 10 and whose potentials are controlled by the signal line driver circuit 2, and a power supply line 7 which are provided with a plurality of branch lines and are electrically connected to the current source 3.

[Configuration Example of the Scan Line Driver Circuit]

Figure 2A:
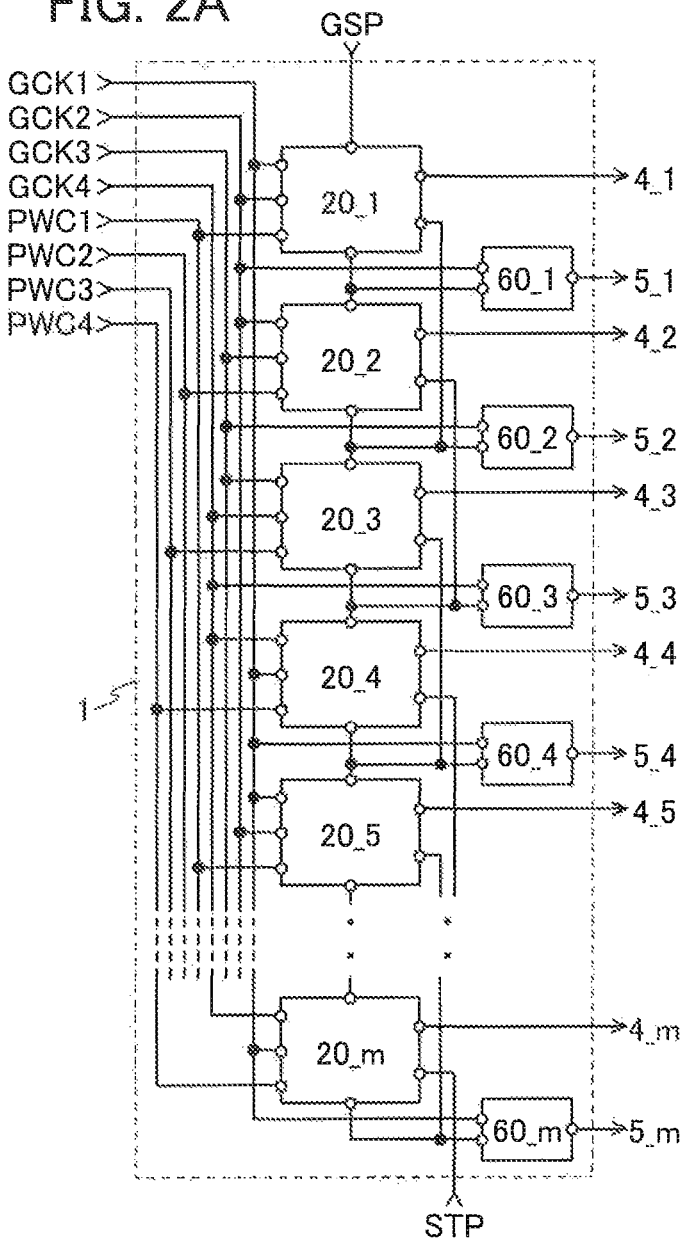
FIG. 2A illustrates a configuration example of a scan line driver circuit.

FIG. 2A illustrates a configuration example of the scan line driver circuit 1 included in the display device in FIG. 1. The scan line driver circuit 1 in FIG. 2A includes wirings for supplying first to fourth clock signals (GCK1 to GCK4) for the scan line driver circuit, wirings for supplying first to fourth pulse-width control signals (PWC1 to PWC4), first to m-th pulse output circuits 20_1 to **20_*m* which are electrically connected to the pixels 10 arranged in first to m-th rows through scan lines 4_1 to 4_*m*, and first to m-th inverted pulse output circuits 60_1 to 60_*m* which are electrically connected to the pixels 10 arranged in the first to m-th rows through inverted scan lines 5_1 to 5_*m***.

The first to m-th pulse output circuits 20_1 to **20_*m* are configured to output a shift pulse sequentially per shift period in response to a start pulse (GSP) for the scan line driver circuit which is input into the first pulse output circuit 20_1. Specifically, after the start pulse (GSP) for the scan line driver circuit is input, the first pulse output circuit 20_1 outputs a shift pulse to the second pulse output circuit 20_2 throughout a shift period. Next, after the shift pulse output from the first pulse output circuit is input to the second pulse output circuit 20_2, the second pulse output circuit 20_2 outputs a shift pulse to the third pulse output circuit 20_3 throughout a shift period. After that, the above operations are repeated until a shift pulse is input to the m-th pulse output circuit 20_*m***.

Further, each of the first to m-th pulse output circuits 20_1 to **20_*m*** has a function of outputting a selection signal to the respective scan lines when the shift pulse is input. Note that the selection signal refers to a signal for turning on a switch whose switching is controlled by a potential of the scan line.

Figure 2B:
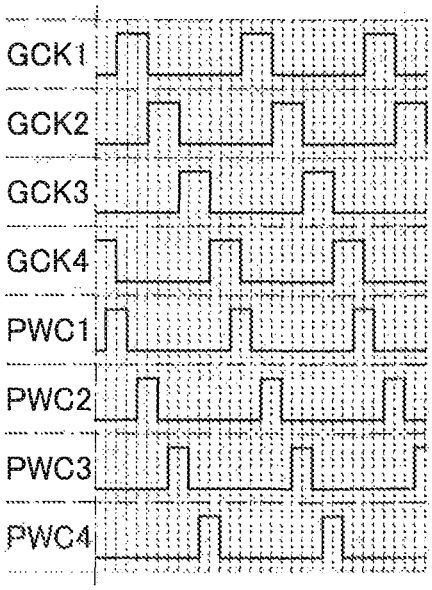
FIG. 2B illustrates examples of waveforms of a variety of signals.

FIG. 2B illustrates examples of specific waveforms of the above-described signals.

Specifically, the first clock signal (GCK1) for the scan line driver circuit in FIG. 2B periodically alternates between a high-level potential (high power supply potential (Vdd)) and a low-level potential (low power supply potential (Vss)), and has a duty ratio of about 1/4. The second clock signal (GCK2) for the scan line driver circuit has a phase shifted by 1/4 period from the first clock signal (GCK1) for the scan line driver circuit; the third clock signal (GCK3) for the scan line driver circuit has a phase shifted by 1/2 period from the first clock signal (GCK1) for the scan line driver circuit; and the fourth clock signal (GCK4) for the scan line driver circuit has a phase shifted by 3/4 period from the first clock signal (GCK1) for the scan line driver circuit.

Further, the potential of the first pulse-width control signal (PWC1) becomes a high-level potential before the potential of the first clock signal (GCK1) for the scan line driver circuit becomes a high-level potential, and becomes a low-level potential in a period when the potential of the first clock signal (GCK1) for the scan line driver circuit is a high-level potential, and the first pulse-width control signal (PWC1) has a duty ratio of less than 1/4. The second pulse-width control signal (PWC2) has a phase shifted by 1/4 period from the first pulse-width control signal (PWC1); the third pulse-width control signal (PWC3) has a phase shifted by 1/2 period from the first pulse-width control signal (PWC1); and the fourth pulse-width control signal (PWC4) has a phase shifted by 3/4 period from the first pulse-width control signal (PWC1).

In the display device in FIG. 2A, the same configuration can be applied to the first to m-th pulse output circuits 20_1 to **20_*m*. Note that electrical connection relations of a plurality of terminals included in the pulse output circuit differ depending on the pulse output circuits. Specific connection relations are described with reference to FIGS. 2A and 2**C.

Each of the first to m-th pulse output circuits 20_1 to **20_*m* has terminals 21 to 27. The terminals 21 to 24 and the terminal 26 are input terminals; the terminals 25 and 27** are output terminals.

First, the terminal 21 is described. The terminal 21 of the first pulse output circuit 20_1 is electrically connected to a wiring for supplying the start pulse (GSP) for the scan line driver circuit. The terminals 21 of the second to m-th pulse output circuits 20_2 to **20_*m* are electrically connected to the respective terminals 27** of their respective previous-stage pulse output circuits.

Next, the terminal 22 is described. The terminal 22 of the (4a−3)-th pulse output circuit (a is a natural number less than or equal to m/4) is electrically connected to the wiring for supplying the first clock signal (GCK1) for the scan line driver circuit. The terminal 22 of the (4a−2)-th pulse output circuit is electrically connected to the wiring for supplying the second clock signal (GCK2) for the scan line driver circuit. The terminal 22 of the (4a−1)-th pulse output circuit is electrically connected to the wiring for supplying the third clock signal (GCK3) for the scan line driver circuit. The terminal 22 of the 4a-th pulse output circuit is electrically connected to the wiring for supplying the fourth clock signal (GCK4) for the scan line driver circuit.

Then, the terminal 23 is described. The terminal 23 of the (4a−3)-th pulse output circuit is electrically connected to the wiring for supplying the second clock signal (GCK2) for the scan line driver circuit. The terminal 23 of the (4a−2)-th pulse output circuit is electrically connected to the wiring for supplying the third clock signal (GCK3) for the scan line driver circuit. The terminal 23 of the (4a−1)-th pulse output circuit is electrically connected to the wiring for supplying the fourth clock signal (GCK4) for the scan line driver circuit. The terminal 23 of the 4a-th pulse output circuit is electrically connected to the wiring for supplying the first clock signal (GCK1) for the scan line driver circuit.

Next, the terminal 24 is described. The terminal 24 of the (4a−3)-th pulse output circuit is electrically connected to the wiring for supplying the first pulse-width control signal (PWC1). The terminal 24 of the (4a−2)-th pulse output circuit is electrically connected to the wiring for supplying the second pulse-width control signal (PWC2). The terminal 24 of the (4a−1)-th pulse output circuit is electrically connected to the wiring for supplying the third pulse-width control signal (PWC3). The terminal 24 of the 4a-th pulse output circuit is electrically connected to the wiring for supplying the fourth pulse-width control signal (PWC4).

Then, the terminal 25 is described. The terminal 25 of the x-th pulse output circuit (x is a natural number smaller than or equal to m) is electrically connected to the scan line **4_*x*** in the x-th row.

Next, the terminal 26 is described. The terminal 26 of the y-th pulse output circuit (y is a natural number smaller than or equal to (m−1)) is electrically connected to the terminal 27 of the (y+1)-th pulse output circuit. The terminal 26 of the m-th pulse output circuit is electrically connected to a wiring for supplying a stop signal (STP) for the m-th pulse output circuit. In the case where a (m+1)-th pulse output circuit is provided, the stop signal (STP) for the m-th pulse output circuit corresponds to a signal output from the terminal 27 of the (m+1)-th pulse output circuit. Specifically, the stop signal (STP) for the m-th pulse output circuit can be supplied to the m-th pulse output circuit by providing the (m+1)-th pulse output circuit as a dummy circuit or by inputting the signal directly from the outside.

The connection relation of the terminal 27 in each of the pulse output circuits has been described above. Therefore, the above description is to be referred to.

In the display device in FIG. 2A, the same configuration can be applied to the first to m-th inverted pulse output circuits 60_1 to **60_*m*. However, electrical connection relations of a plurality of terminals included in the inverted pulse output circuit differ depending on the inverted pulse output circuit. Specific connection relations are described with reference to FIGS. 2A and 2**D.

Each of the first to m-th inverted pulse output circuits 60_1 to **60_*m* has terminals 61 to 63. The terminals 61 and 62 are input terminals; the terminal 63 is an output terminal First, the terminal 61 is described. The terminal 61 of the (4a−3)-th inverted pulse output circuit is electrically connected to the wiring for supplying the second clock signal (GCK2) for the scan line driver circuit. The terminal 61 of the (4a−2)-th inverted pulse output circuit is electrically connected to the wiring for supplying the third clock signal (GCK3) for the scan line driver circuit. The terminal 61 of the (4a−1)-th inverted pulse output circuit is electrically connected to the wiring for supplying the fourth clock signal (GCK4) for the scan line driver circuit. The terminal 61 of the 4a-th inverted pulse output circuit is electrically connected to the wiring for supplying the first clock signal (GCK1**) for the scan line driver circuit.

Next, the terminal 62 is described. The terminal 62 of the x-th inverted pulse output circuit is electrically connected to the terminal 27 of the x-th pulse output circuit.

Then, the terminal 63 is described. The terminal 63 of the x-th inverted pulse output circuit is electrically connected to the inverted scan line 5_*x* in the x-th row.

[Configuration Example of the Pulse Output Circuit]

Figure 2C:
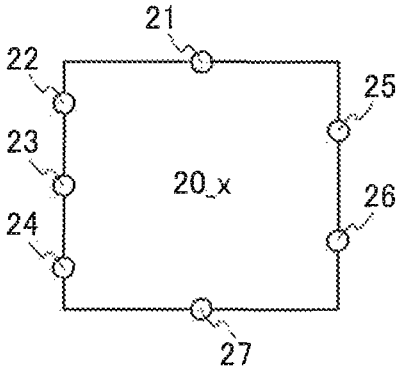
FIG. 2C illustrates terminals of a pulse output circuit.
Figure 3A:
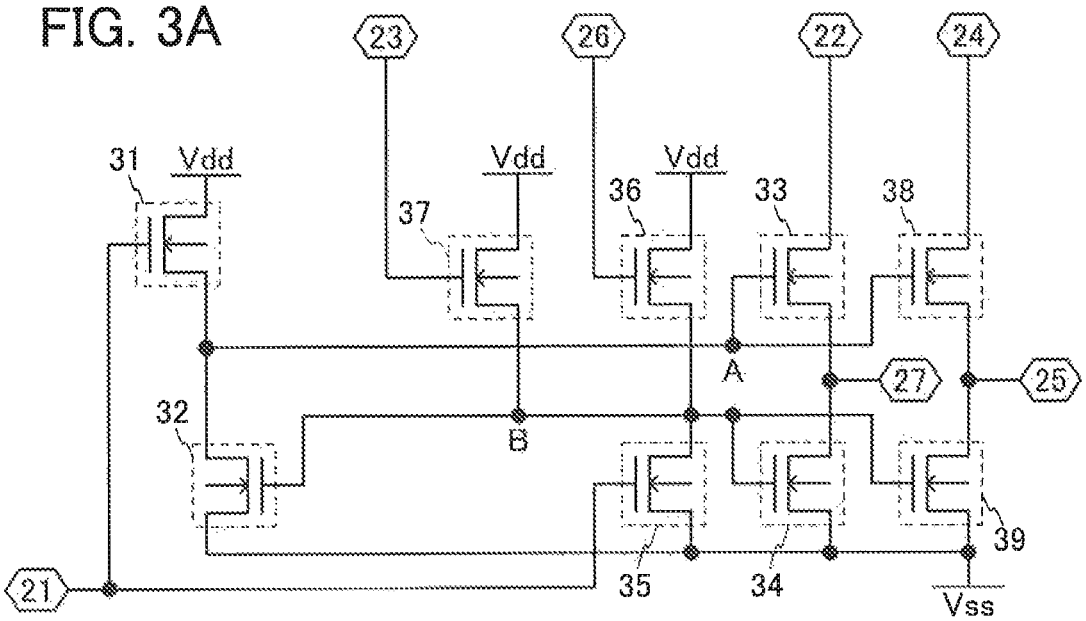
FIG. 3A illustrates a configuration example of a pulse output circuit.

FIG. 3A illustrates a configuration example of the pulse output circuit illustrated in FIGS. 2A and 2C. The pulse output circuit illustrated in FIG. 3A includes transistors 31 to 39.

One of a source and a drain of the transistor 31 is electrically connected to a wiring that supplies the high power supply potential (Vdd) (hereinafter also referred to as high power supply potential line); and a gate of the transistor 31 is electrically connected to the terminal 21.

One of a source and a drain of the transistor 32 is electrically connected to a wiring for supplying the low power supply potential (Vss) (hereinafter also referred to as low power supply potential line); and the other of the source and the drain of the transistor 32 is electrically connected to the other of the source and the drain of the transistor 31.

One of a source and a drain of the transistor 33 is electrically connected to the terminal 22; the other of the source and the drain of the transistor 33 is electrically connected to the terminal 27; and a gate of the transistor 33 is electrically connected to the other of the source and the drain of the transistor 31 and the other of the source and the drain of the transistor 32.

One of a source and a drain of the transistor 34 is electrically connected to the low power supply potential line; the other of the source and the drain of the transistor 34 is electrically connected to the terminal 27; and a gate of the transistor 34 is electrically connected to a gate of the transistor 32.

One of a source and a drain of the transistor 35 is electrically connected to the low power supply potential line; the other of the source and the drain of the transistor 35 is electrically connected to the gate of the transistor 32 and the gate of the transistor 34; and a gate of the transistor 35 is electrically connected to the terminal 21.

One of a source and a drain of the transistor 36 is electrically connected to the high power supply potential line; the other of the source and the drain of the transistor 36 is electrically connected to the gate of the transistor 32, the gate of the transistor 34, and the other of the source and the drain of the transistor 35; and a gate of the transistor 36 is electrically connected to the terminal 26.

One of a source and a drain of the transistor 37 is electrically connected to the high power supply potential line; the other of the source and the drain of the transistor 37 is electrically connected to the gate of the transistor 32, the gate of the transistor 34, the other of the source and the drain of the transistor 35, and the other of the source and the drain of the transistor 36; and a gate of the transistor 37 is electrically connected to the terminal 23.

One of a source and a drain of the transistor 38 is electrically connected to the terminal 24; the other of the source and the drain of the transistor 38 is electrically connected to the terminal 25; and a gate of the transistor 38 is electrically connected to the other of the source and the drain of the transistor 31, the other of the source and the drain of the transistor 32, and the gate of the transistor 33.

One of a source and a drain of the transistor 39 is electrically connected to the low power supply potential line; the other of the source and the drain of the transistor 39 is electrically connected to the terminal 25; and a gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

Note that in the following description, a node where the other of the source and the drain of the transistor 31, the other of the source and the drain of the transistor 32, the gate of the transistor 33, and the gate of the transistor 38 are electrically connected is referred to as node A. In addition, a node where the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected is referred to as node B.

[Operation Example of the Pulse Output Circuit]

Figure 3B:
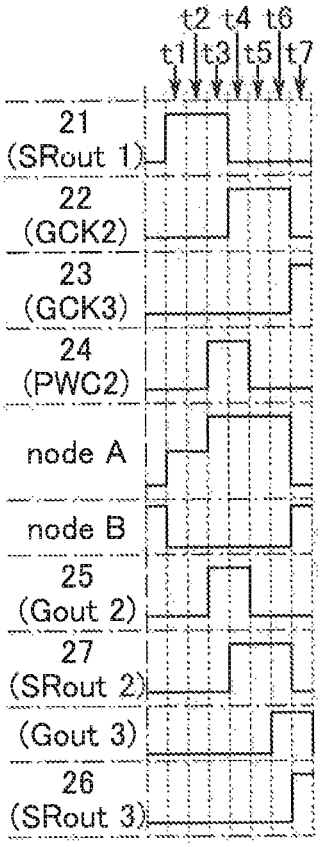
FIG. 3B illustrates an operation example thereof.

An operation example of the above-described pulse output circuit is described with reference to FIG. 3B. Specifically, FIG. 3B illustrates signals input to the respective terminals of the second pulse output circuit 20_2 when a shift pulse is input from the first pulse output circuit 20_1, potentials of signals output from the respective terminals, and potentials of the nodes A and B. Further, a signal output from the terminal 25 of the third pulse output circuit 20_3 (Gout3) and a signal output from the terminal 27 thereof (SRout3, signal input to the terminal 26 of the second pulse output circuit 20_2) are also illustrated. Note that in FIG. 3B, Gout represents a signal output from any of the pulse output circuits to the corresponding scan line, and SRout represents a signal output from any of the pulse output circuits to the subsequent-stage pulse output circuit.

First, with reference to FIG. 3B, a case where a shift pulse is input from the first pulse output circuit 20_1 to the second pulse output circuit 20_2 is described.

In a period t1, a high-level potential (high power supply potential (Vdd)) is input to the terminal 21. Thus, the transistors 31 and 35 are on. As a result, the potential of the node A is increased to a high-level potential (potential decreased from the high power supply potential (Vdd) by the threshold voltage of the transistor 31), and the potential of the node B is decreased to the low power supply potential (Vss). Accordingly, the transistors 33 and 38 are on and the transistors 32, 34, and 39 are off. From the above, in the period t1, a signal output from the terminal 27 is input to the terminal 22, and a signal output from the terminal 25 is input to the terminal 24. Here in the period t1, both the signal input to the terminal 22 and the signal input to the terminal 24 are at the low-level potential (low power supply potential (Vss)). Accordingly, in the period t1, the second pulse output circuit 20_2 outputs a low-level potential (low power supply potential (Vss)) to the terminal 21 of the third pulse output circuit 20_3 and the scan line in the second row in a pixel portion.

In a period t2, the levels of the signals input to the terminals are not changed from those in the period t1. Therefore, the potentials of the signals output from the terminals 25 and 27 are not changed either; the low-level potentials (low power supply potentials (Vss)) are output therefrom.

In a period t3, a high-level potential (high power supply potential (Vdd)) is input to the terminal 24. Note that the potential of the node A (potential of the source of the transistor 31) is increased to a high-level potential (potential which is decreased from the high power supply potential (Vdd)) by the threshold voltage of the transistor 31) in the period t1. Therefore, the transistor 31 is off. At this time, the input of the high-level potential (high power supply potential (Vdd)) to the terminal 24 further increases the potential of the node A (potential of the gate of the transistor 38) by using capacitive coupling between the gate and the source the transistor 38 (bootstrapping). Owing to the bootstrapping, the potential of the signal output from the terminal 25 is not decreased from the high-level potential (high power supply potential (Vdd)) input to the terminal 24. Accordingly, in the period t3, the second pulse output circuit 20_2 outputs a high-level potential (high power supply potential (Vdd)=a selection signal) to the scan line in the second row in the pixel portion.

In a period t4, a high-level potential (high power supply potential (Vdd)) is input to the terminal 22. As a result, since the potential of the node A has been increased by the bootstrapping, the potential of the signal output from the terminal 27 is not decreased from the high-level potential (high power supply potential (Vdd)) input to the terminal 22. Accordingly, in the period t4, the terminal 27 outputs the high-level potential (high power supply potential (Vdd)) which is input to the terminal 22. That is, the second pulse output circuit 20_2 outputs a high-level potential (high power supply potential (Vdd)=a shift pulse) to the terminal 21 of the third pulse output circuit 20_3. In the period t4, the potential of the signal input to the terminal 24 is kept at the high-level potential (high power supply potential (Vdd)), so that the potential of the signal output to the scan line in the second row in the pixel portion from the second pulse output circuit 20_2 is kept at the high-level potential (high power supply potential (Vdd)=the selection signal). Further, a low-level potential (low power supply potential (Vss)) is input to the terminal 21 to tune off the transistor 35, which does not directly influence the signals output from the second pulse output circuit 20_2 in the period t4.

In a period t5, a low-level potential (low power supply potential (Vss)) is input to the terminal 24. In that period, the transistor 38 keeps being on. Accordingly, in the period t5, the second pulse output circuit 20_2 outputs the low-level potential (low power supply potential (Vss)) to the scan line in the second row in the pixel portion.

In a period t6, the levels of the signals input to the terminals are not changed from those in the period t5. Therefore, the potentials of the signals output from the terminals 25 and 27 are not changed either; the low-level potential (low power supply potentials (Vss)) is output from the terminal 25 and the high-level potential (high power supply potential (Vdd)=the shift pulse) is output from the terminal 27.

In a period t7, a high-level potential (high power supply potential (Vdd)) is input to the terminal 23. Thus, the transistor 37 is on. As a result, the potential of the node B is increased to a high-level potential (potential that is decreased from the high power supply potential (Vdd) by the threshold voltage of the transistor 37), so that the transistors 32, 34, and 39 are on. Accordingly, the potential of the node A is decreased to the low-level potential (low power supply potential (Vss)), so that the transistors 33 and 38 are off. From the above, in the period t7, both of the signals output from the terminals 25 and 27 are at a low power supply potential (Vss). In other words, in the period t7, the second pulse output circuit 20_2 outputs a low power supply potential (Vss) to the terminal 21 of the third pulse output circuit 20_3 and to the scan line in the second row in the pixel portion.

[Configuration Example of the Inverted Pulse Output Circuit]

Figure 2D:
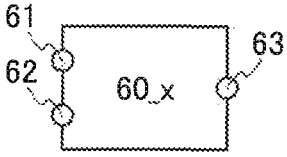
FIG. 2D illustrates terminals of an inverted pulse output circuit.
Figure 3C:
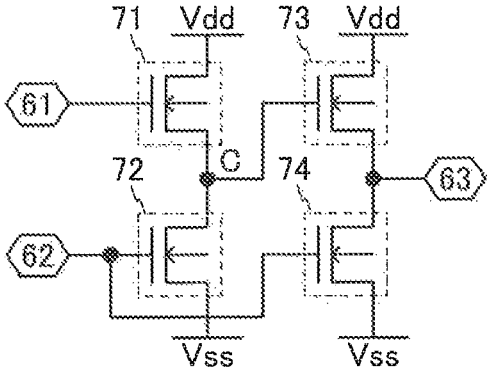
FIG. 3C illustrates a configuration example of an inverted pulse output circuit.

FIG. 3C illustrates a configuration example of the inverted pulse output circuit illustrated in FIGS. 2A and 2D. The inverted pulse output circuit in FIG. 3C includes transistors 71 to 74.

One of a source and a drain of the transistor 71 is electrically connected to the high power supply potential line; and a gate of the transistor 71 is electrically connected to the terminal 61.

One of a source and a drain of the transistor 72 is electrically connected to the low power supply potential line; the other of the source and the drain of the transistor 72 is electrically connected to the other of the source and the drain of the transistor 71; and a gate of the transistor 72 is electrically connected to the terminal 62.

One of a source and a drain of the transistor 73 is electrically connected to the high power supply potential line; the other of the source and the drain of the transistor 73 is electrically connected to the terminal 63; and a gate of the transistor 73 is electrically connected to the other of the source and the drain of the transistor 71 and the other of the source and the drain of the transistor 72.

One of a source and a drain of the transistor 74 is electrically connected to the low power supply potential line; the other of the source and the drain of the transistor 74 is electrically connected to the terminal 63; and a gate of the transistor 74 is electrically connected to the terminal 62.

Note that in the following description, a node where the other of the source and the drain of the transistor 71, the other of the source and the drain of the transistor 72, and the gate of the transistor 73 are electrically connected is referred to as node C.

[Operation Example of the Inverted Pulse Output Circuit]

Figure 3D:
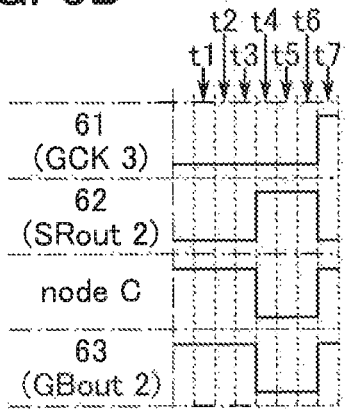
FIG. 3D illustrates an operation example thereof.

An operation example of the inverted pulse output circuit is described with reference to FIG. 3D. Specifically, FIG. 3D illustrates signals input to the respective terminals of the second inverted pulse output circuit 20_2, potentials of signals output therefrom, and potentials of the node C in the periods t1 to t7 in FIG. 3B. Note that in FIG. 3D, the signals input to the terminals are each shown in parentheses. Further, in FIG. 3D, GBout represents a signal output to any of the inverted scan line of the inverted pulse output circuits.

In the periods t1 to t3, low-level potentials are input to the terminals 61 and 62. Thus, the transistors 71, 72, and 74 are off. Accordingly, the potential of the node C is kept at the high-level potential. Accordingly, the transistor 73 is on. The potential of the node C is higher than the sum of the high power supply potential (Vdd) and the threshold voltage of the transistor 73 by using capacitive coupling between the gate and the source (the other of the source and the drain electrically connected to the terminal 63 in the periods t1 to t3) of the transistor 73 (bootstrapping). From the above, in the periods t1 to t3, the potential of the signal output from the terminal 63 is the high power supply potential (Vdd). That is, in the periods t1 to t3, the second inverted pulse output circuit 602 outputs the high power supply potential (Vdd) to the inverted scan line in the second row in the pixel portion.

In the period t4, a high-level potential (high power supply potential (Vdd)) is input to the terminal 62. Thus, the transistors 72 and 74 are on. Accordingly, the potential of the node C is decreased to a low-level potential (low power supply potential (Vss)), so that the transistor 73 is off. From the above, in the period t4, the potential of the signal output from the terminal 63 becomes the low power supply potential (Vss). That is, in the period t4, the second inverted pulse output circuit 602 outputs the low power supply potential (Vss) to the inverted scan line in the second row in the pixel portion.

In the periods t5 and t6, the levels of the signals input to the terminals are not changed from those in the period t4. Therefore, the potential of the signal output from the terminal 63 is not changed either; the low-level potential (low power supply potential (Vss)) is output.

In the period t7, a high-level potential (high power supply potential (Vdd)) is input to the terminal 61 and a low-level potential (low power supply potential (Vss)) is input to the terminal 62. Thus, the transistor 71 is on and the transistors 72 and 74 are off. Accordingly, the potential of the node C is increased to a high-level potential (potential decreased from the high power supply potential (Vdd) by the threshold voltage of the transistor 71), so that the transistor 73 is on. Further, the potential of the node C becomes higher than the sum of the high power supply potential (Vdd) and the threshold voltage of the transistor 73 by using capacitive coupling between the gate and the source of the transistor 73 (bootstrapping). From the above, in the period t7, the potential of the signal output from the terminal 63 becomes the high power supply potential (Vdd). That is, in the period t7, the second inverted pulse output circuit 602 outputs the high power supply potential (Vdd) to the inverted scan line in the second row in the pixel portion.

[Configuration Example of the Pixel]

Figure 4A:
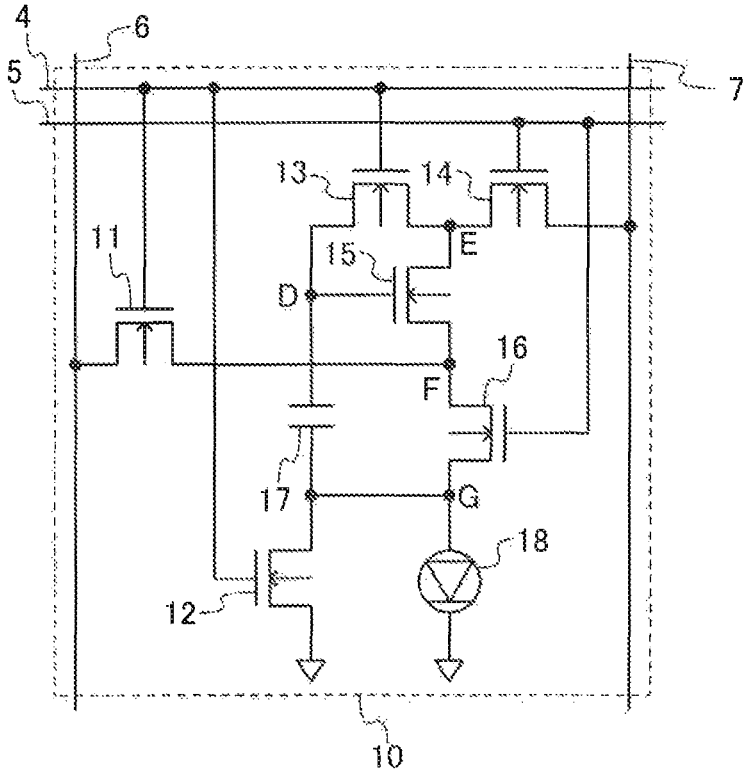
FIG. 4A illustrates a configuration example of a pixel.

FIG. 4A is a circuit diagram illustrating a configuration example of the pixel 10 in FIG. 1. The pixel 10 in FIG. 4A includes transistors 11 to 16, a capacitor 17, and an element 18 including an organic material that emits light by current excitation between a pair of electrodes (hereinafter also referred to as organic electroluminescent (EL) element).

One of a source and a drain of the transistor 11 is electrically connected to the signal line 6; and a gate of the transistor 11 is electrically connected to the scan line 4.

One of a source and a drain of the transistor 12 is electrically connected to a wiring for supplying a common potential; and a gate of the transistor 12 is electrically connected to the scan line 4. Note that the common potential here is lower than a potential given to the power supply line 7.

A gate of the transistor 13 is electrically connected to the scan line 4.

One of a source and a drain of the transistor 14 is electrically connected to the power supply line 7; the other of the source and the drain of the transistor 14 is electrically connected to one of a source and a drain of the transistor 13; and a gate of the transistor 14 is electrically connected to the inverted scan line 5.

One of a source and a drain of the transistor 15 is electrically connected to the one of the source and the drain of the transistor 13 and the other of the source and the drain of the transistor 14; the other of the source and the drain of the transistor 15 is electrically connected to the other of the source and the drain of the transistor 11; and a gate of the transistor 15 is electrically connected to the other of the source and the drain of the transistor 13.

One of a source and a drain of the transistor 16 is electrically connected to the other of the source and the drain of the transistor 11 and the other of the source and the drain of the transistor 15; the other of the source and the drain of the transistor 16 is electrically connected to the other of the source and the drain of the transistor 12; and a gate of the transistor 16 is electrically connected to the inverted scan line 5.

One electrode of the capacitor 17 is electrically connected to the other of the source and the drain of the transistor 13 and the gate of the transistor 15; and the other electrode of the capacitor 17 is electrically connected to the other of the source and the drain of the transistor 12 and the other of the source and the drain of the transistor 16.

An anode of the organic EL element 18 is electrically connected to the other of the source and the drain of the transistor 12, the other of the source and the drain of the transistor 16, and the other electrode of the capacitor 17. A cathode of the organic EL element 18 is electrically connected to the wiring for supplying the common potential. Note that the common potential given to the wiring electrically connected to the one of the source and the drain of the transistor 12 may be different from the common potential given to the cathode of the organic EL element 18.

Hereinafter, a node where the other of the source and the drain of the transistor 13, the gate of the transistor 15, and the one electrode of the capacitor 17 are electrically connected is referred to as node D. A node where the one of the source and the drain of the transistor 13, the other of the source and the drain of the transistor 14, and the one of the source and the drain of the transistor 15 are electrically connected is referred to as node E. A node where the other of the source and the drain of the transistor 11, the other of the source and the drain of the transistor 15, and the one of the source and the drain of the transistor 16 are electrically connected is referred to as node F. A node where the other of the source and the drain of the transistor 12, the other of the source and the drain of the transistor 16, the other electrode of the capacitor 17, and the anode of the organic EL element 18 are electrically connected is referred to as node G.

[Operation Example of the Pixel]

Figure 4B:
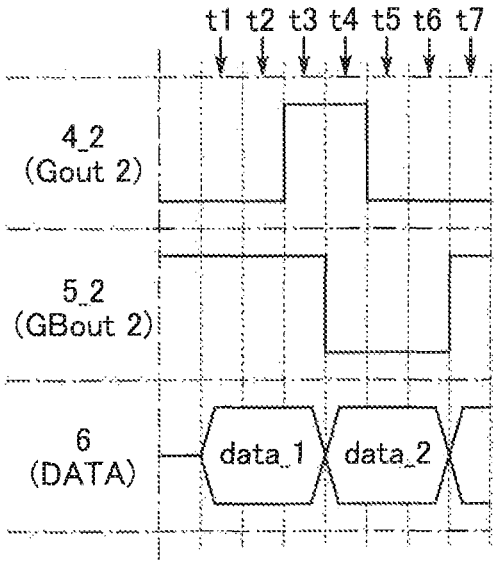
FIG. 4B illustrates an operation example thereof.

An operation example of the above pixel is described with reference to FIG. 4B. Specifically, FIG. 4B illustrates potentials of the scan line 4_2 and the inverted scan line 5_2 which are arranged in the second row in the pixel portion, and image signals input to the signal line 6 in the periods t1 to t7 in FIGS. 3B and 3D. In FIG. 4B, the signals which are input to the wirings are each shown in parentheses. Further, in FIG. 4B, "DATA" represents an image signal.

In the periods t1 and t2, the selection signal is not input to the scan line 4_2, and the selection signal is input to the inverted scan line 5_2. Thus, the transistors 11, 12, and 13 are off, and the transistors 14 and 16 are on. Accordingly, current corresponding to the potential of the gate of the transistor 15 (potential of the node D) is supplied from the power supply line to the organic EL element 18. That is, the pixel 10 displays an image in accordance with an image signal held in the capacitor 17. Note that in the periods t1 and t2, an image signal (data_1) for the pixels arranged in the first row is input from the signal line driver circuit 2 to the signal line 6.

In the period t3, the selection signal is input to the scan line 4_2. Thus, the transistors 11, 12, and 13 are on, resulting in a short circuit between the one electrode of the capacitor 17 and the signal line 6 and between the one electrode of the capacitor 17 and the power supply line 7, for example. Accordingly, the image signal held in the capacitor 17 is lost (initialization).

In the period t4, the selection signal is not input to the inverted scan line 5_2. Thus, the transistors 14 and 16 are off. Further, an image signal (data_2) for the pixels arranged in the second row is input to the signal line 6. Accordingly, the node F has a potential corresponding to the image signal (data_2).

Note that in the period t4, the nodes D and E have a potential that is the sum of the potential corresponding to the image signal (data_2) and the threshold voltage of the transistor 15 (hereinafter referred to as data potential). This is because when the nodes D and E have a potential higher than the data potential, the transistor 15 is on and the potentials of the nodes D and E are decreased to the data potential. Further, even when, after the transistors 14 and 16 are off and the transistor 15 is off (after the nodes D and E have a potential equal to the sum of the potential of the node F and the threshold voltage of the transistor 15), the potential of the node F changes to the potential corresponding to the image signal (data_2), the potential of the node D changes by using capacitive coupling between the nodes D and F. Accordingly, the potentials of the nodes D and E are also decreased to the data potential in this case.

In the period t4, the potential of the node G becomes the common potential owing to a short circuit between the node G and a wiring for supplying the common potential through the transistor 12.

Accordingly, in the period t4, the voltage applied to the capacitor 17 equals the difference between the data potential (potential of the node D) and the common potential (potential of the node G).

In the periods t5 and t6, the selection signal is not input to the scan line 4_2. Thus, the transistors 11, 12, and 13 are off.

In the period t7, the selection signal is input to the inverted scan line 5_2. Thus, the transistors 14 and 16 are on. Note that it is known that a drain current in a saturated region of a transistor is proportional to the square of the potential difference between the threshold voltage of the transistor and a voltage between a gate and a source of the transistor. Here, the voltage between the gate and the source of the transistor 15 becomes a voltage applied to the capacitor 17 (difference between the data potential (sum of the potential corresponding to the image signal (data_2) and the threshold voltage of the transistor 15) and the common potential). Accordingly, the drain current in the saturated region of the transistor 15 is proportional to the square of the difference between the potential corresponding to the image signal (data_2) and the common potential. In this case, the drain current in the saturated region of the transistor 15 is not dependent on the threshold voltage of the transistor 15.

Note that the potential of the node G changes so that the same current as that generated in the transistor 15 flows to the organic EL element 18. Here, when the potential of the node G changes, the potential of the node D changes by using capacitive coupling through the capacitor 17. Therefore, even when the potential of the node G changes, the transistor 15 can supply a constant current to the organic EL element 18.

Through the above operations, the pixels 10 display an image in accordance with the image signal (data_2).

[Display Device Disclosed in this Specification]

In the display device disclosed in this specification, the operation of the inverted pulse output circuits is controlled by at least two kinds of signals. Thus, through current generated in the inverted pulse output circuits can be reduced. Further, signals used for the operation of the plurality of pulse output circuits are used as the two kinds of signals. That is, the inverted pulse output circuits can operate without generating a signal additionally.

[Variations]

The above display device is one embodiment of the invention; the invention also includes a display device that has a structure different from the structure of the above display device. The following shows examples of another embodiment of the invention. Note that the invention also includes a display device having any of the following plurality of elements shown as the examples of another embodiment of the invention.

[Variations of the Display Device]

As the above-described display device, the display device including the organic EL element in each pixel (hereinafter also referred to as EL display device) has been exemplified; however, the display device of the invention is not limited to the EL display device. For example, the display device of the invention may be a display device that displays an image by controlling the alignment of liquid crystals (liquid crystal display device).

[Variations of the Scan Line Driver Circuit]

Further, the configuration of the scan line driver circuit included in the above-described display device is not limited to that in FIG. 2A. For example, it is possible to use any of scan line driver circuits in FIG. 5, FIG. 6A, and FIG. 7 as the scan line driver circuit included in the above display device.

Figure 5:
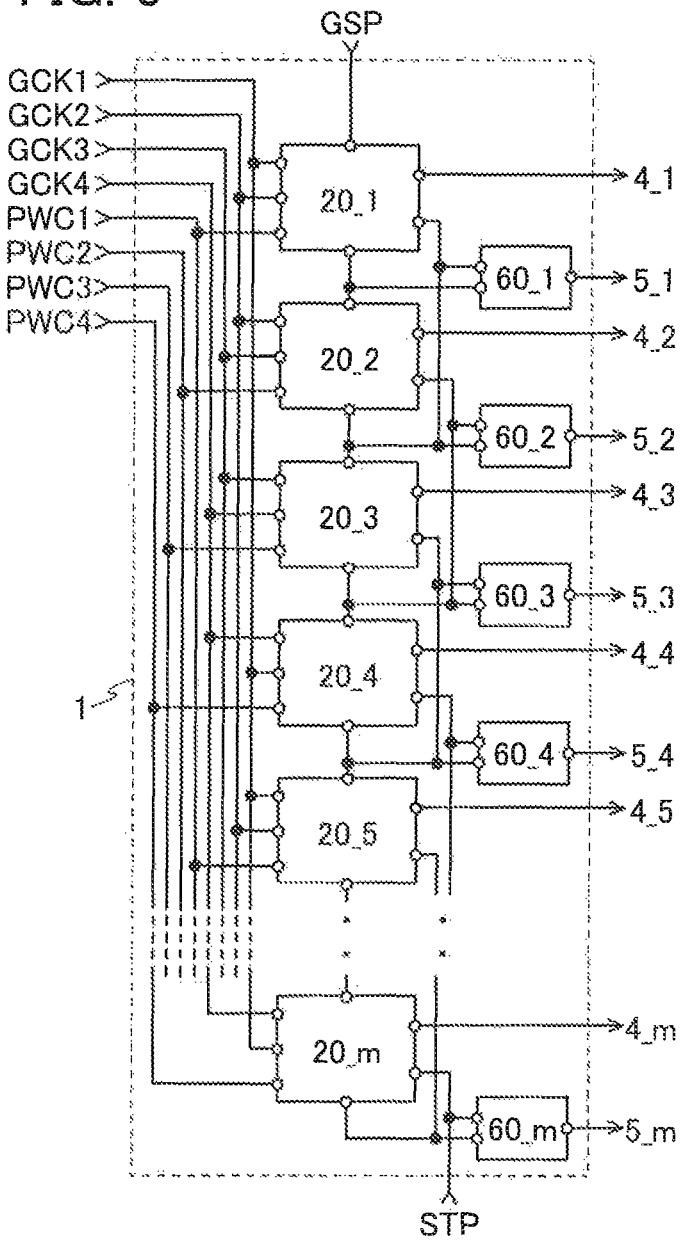
FIG. 5 illustrates a variation of a scan line driver circuit.

The scan line driver circuit 1 in FIG. 5 is different from the scan line driver circuit 1 in FIG. 2A in that the terminal 61 of the y-th inverted pulse output circuit 60_*y* (y is a natural number smaller than or equal to (m−1)) is electrically connected to the terminal 27 of a (y+1)-th pulse output circuit and that the terminal 61 of the m-th inverted pulse output circuit 60_*m* is electrically connected to a wiring for supplying a stop signal (STP) for the m-th pulse output circuit. The scan line driver circuit 1 in FIG. 5 can also output, to the scan lines and the inverted scan lines, signals similar to those output from the scan line driver circuit 1 in FIG. 2A.

In the scan line driver circuit 1 in FIG. 2A, a high-level potential is input to the terminal 61 of the inverted pulse output circuit in a shorter cycle than in the scan line driver circuit 1 in FIG. 5. That is, the transistor 71 included in the inverted pulse output circuit is on in a shorter cycle (see FIGS. 2A, 2B, 2D and FIG. 3C). Accordingly, even when the potential of the gate of the transistor 73 included in the inverted pulse output circuit is decreased owing to leakage current generated in the transistor 72 or the like, the potential can be increased again. Thus, it is possible to reduce the probability that the inverted pulse output circuit outputs a potential lower than the high power supply potential (Vdd) to the corresponding inverted scan line.

On the other hand, in the scan line driver circuit 1 in FIG. 5, parasitic capacitances of the wirings for supplying the first to fourth clock signals (GCK1 to GCK4) for the scan line driver circuit can be lower than those in the scan line driver circuit 1 in FIG. 2A. Therefore, the scan line driver circuit 1 in FIG. 5 can have lower power consumption than the scan line driver circuit 1 in FIG. 2A.

Figure 6A:
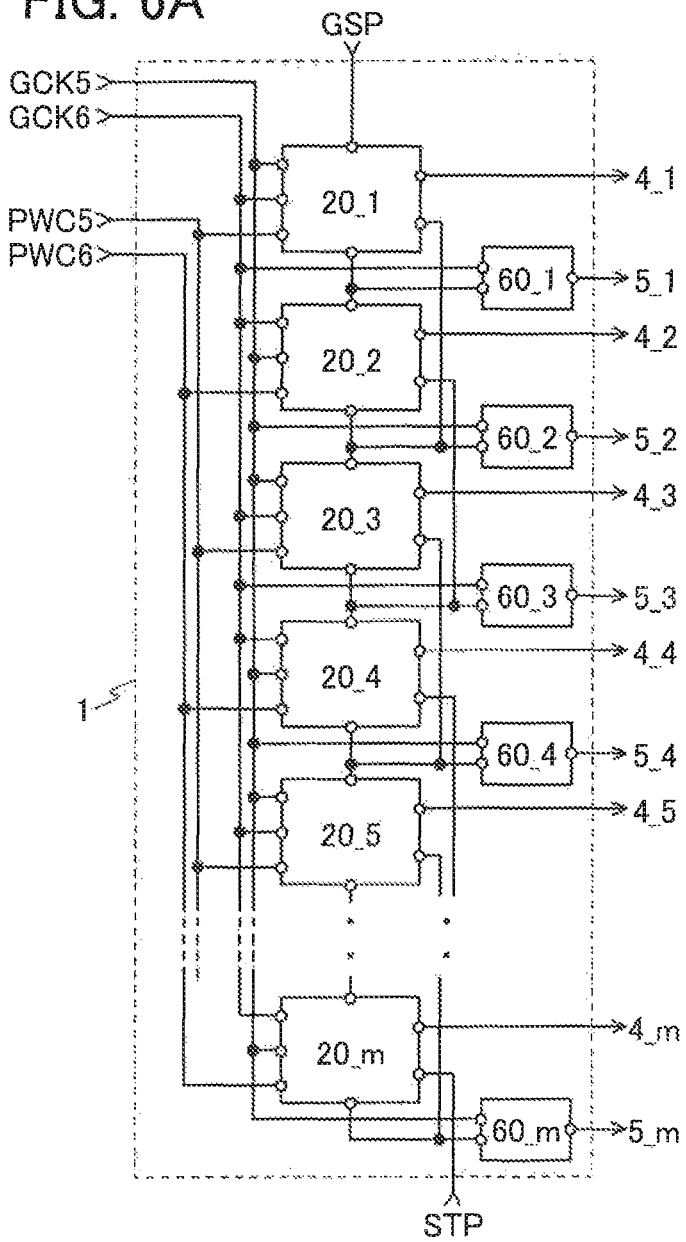
FIG. 6A illustrates a variation of a scan line driver circuit.

The scan line driver circuit 1 in FIG. 6A is different from the scan line driver circuit 1 in FIG. 2A in that it operates with two kinds of clock signals for the scan line driver circuit and two kinds of pulse-width control signals. Accordingly, the connection relations between the pulse output circuits and the inverted pulse output circuits are also different (see FIG. 6A).

Specifically, the scan line driver circuit 1 in FIG. 6A includes a wiring for supplying a fifth clock signal (GCK5) for the scan line driver circuit, a wiring for supplying a sixth clock signal (GCK6) for the scan line driver circuit, a wiring for supplying a fifth pulse-width control signal (PWC5), and a wiring for supplying a sixth pulse-width control signal (PWC6).

Figure 6B:
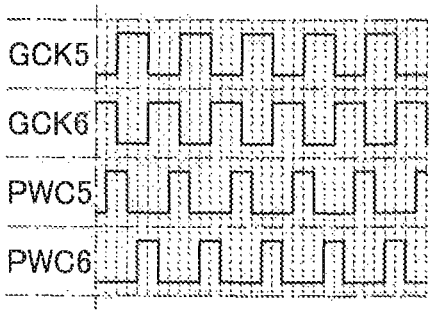
FIG. 6B illustrates examples of waveforms of a variety of signals.

FIG. 6B illustrates examples of specific waveforms of the above-described signals in FIG. 6A. The fifth clock signal (GCK5) for the scan line driver circuit in FIG. 6B periodically alternates between a high-level potential (high power supply potential (Vdd)) and a low-level potential (low power supply potential (Vss)), and has a duty ratio of about 1/2. Further, the sixth clock signal (GCK6) for the scan line driver circuit has a phase shifted by 1/2 period from the fifth clock signal (GCK5) for the scan line driver circuit. The potential of the fifth pulse-width control signal (PWC5) becomes a high-level potential before the potential of the fifth clock signal (GCK5) for the scan line driver circuit becomes a high-level potential, and becomes a low-level potential in a period when the potential of the fifth clock signal (GCK5) for the scan line driver circuit is a high-level potential, and the fifth pulse-width control signal (PWC5) has a duty ratio of less than 1/2. The sixth pulse-width control signal (PWC6) has a phase shifted by 1/2 period from the fifth pulse width control signal (PWC5).

The scan line driver circuit 1 in FIG. 6A can also output signals similar to those output from the scan line driver circuit 1 in FIG. 2A to the scan lines and the inverted scan lines.

Note that in the scan line driver circuit 1 in FIG. 2A, parasitic capacitances of the wirings for supplying the first to fourth clock signals (GCK1 to GCK4) for the scan line driver circuit can be lower than those in the scan line driver circuit 1 in FIG. 6A. Therefore, the scan line driver circuit 1 in FIG. 2A can have lower power consumption than the scan line driver circuit 1 in FIG. 6A.

On the other hand, in the scan line driver circuit 1 in FIG. 6A, the number of signals necessary for the operation of the scan line driver circuit can be smaller than in the scan line driver circuit 1 in FIG. 2A.

Figure 7:
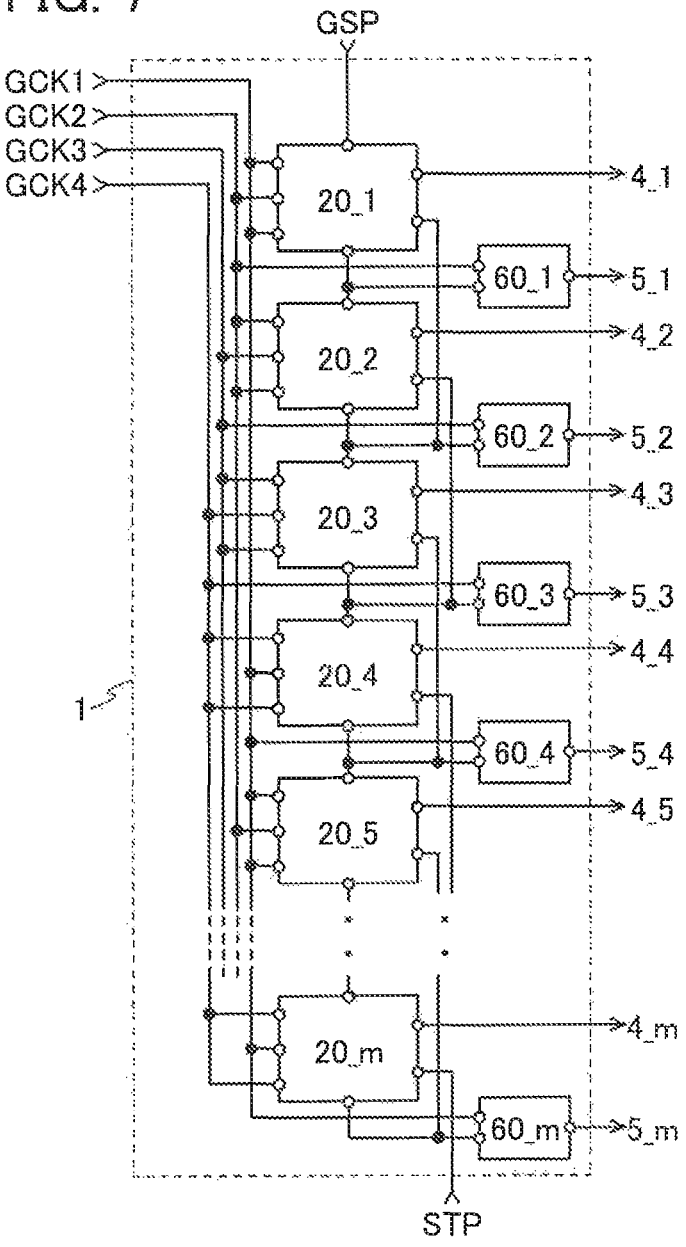
FIG. 7 illustrates a variation of a scan line driver circuit.

The scan line driver circuit 1 in FIG. 7 is different from the scan line driver circuit 1 in FIG. 2A in that it operates without the pulse-width control signals. Accordingly, the connection relations between the pulse output circuits and the inverted pulse output circuits are also different (see FIG. 7).

In the scan line driver circuit 1 in FIG. 7, the selection signal output from the pulse output circuit to the corresponding scan line is the same signal as the shift pulse output to the subsequent-stage pulse output circuit. Thus, the signal output from the pulse output circuit to the scan line (potential of the scan line) and the signal output from the inverted pulse output circuit to the inverted scan line (potential of the inverted scan line) have opposite phases. It is possible to use the scan line driver circuit 1 in FIG. 7 as the scan line driver circuit included in the display device.

Note that in the scan line driver circuit 1 in FIG. 2A, there is a wider interval between a period for outputting the selection signal to the scan line in the y-th row and a period for outputting the selection signal to the scan line in the (y+1)-th row, than in the scan line driver circuit 1 in FIG. 7. Thus, even when any of the first to fourth clock signals (GCK1 to GCK4) for the scan line driver circuit is delayed or has a blunt waveform, the scan line driver circuit 1 in FIG. 7 can input image signals to pixels accurately compared to the scan line driver circuit 1 in FIG. 6A.

On the other hand, in the scan line driver circuit 1 in FIG. 7, the number of signals necessary for the operation of the scan line driver circuit can be smaller than that in the scan line driver circuit 1 in FIG. 2A.

[Variations of the Pulse Output Circuit]

The configuration of the pulse output circuit included in the above scan line driver circuit is not limited to that in FIG. 3A. For example, it is possible to use any of pulse output circuits in FIGS. 8A and 8B and FIGS. 9A and 9B as the pulse output circuit included in the above scan line driver circuit.

Figure 8A:
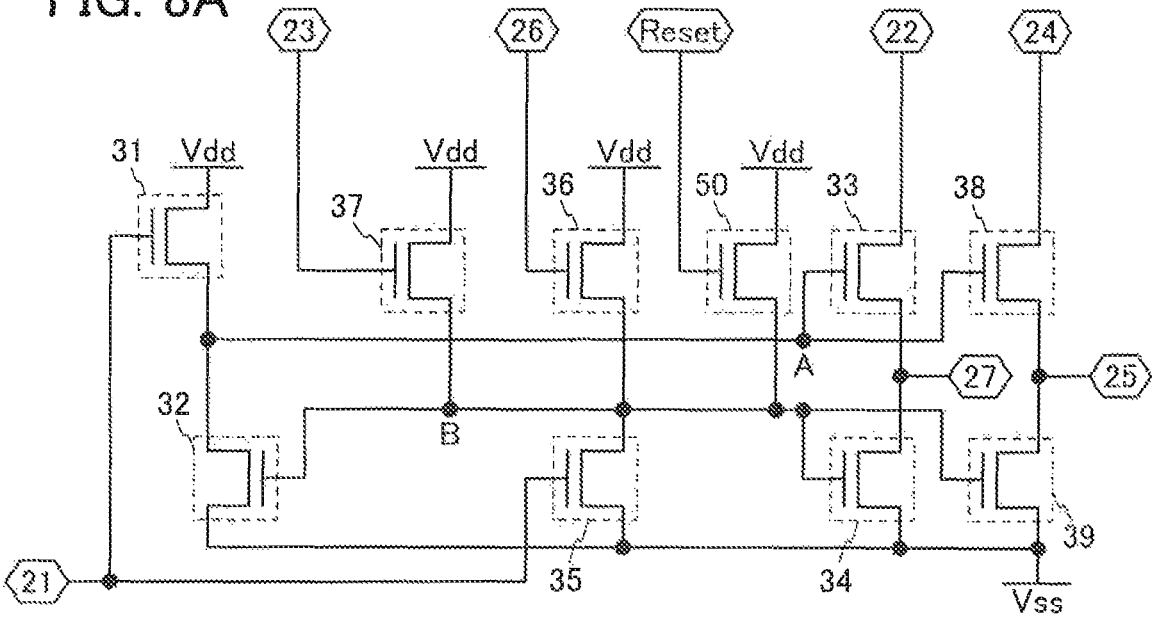
FIGS. 8A and 8B illustrate variations of a pulse output circuit.

Further, the pulse output circuit in FIG. 8A has a configuration in which a transistor 50 is added to the pulse output circuit in FIG. 3A. One of a source and a drain of the transistor 50 is electrically connected to the high power supply potential line; the other of the source and the drain of the transistor 50 is electrically connected to the gate of the transistor 32, the gate of the transistor 34, the other of the source and the drain of the transistor 35, the other of the source and the drain of the transistor 36, the other of the source and the drain of the transistor 37, and the gate of the transistor 39; and a gate of the transistor 50 is electrically connected to a reset terminal (Reset). Note that to the reset terminal, a high-level potential can be input in a vertical retrace period of the display device and a low-level potential can be input in periods other than the vertical retrace period. Thus, the potential of each node of the pulse output circuit can be initialized, so that malfunction can be prevented.

Figure 8B:
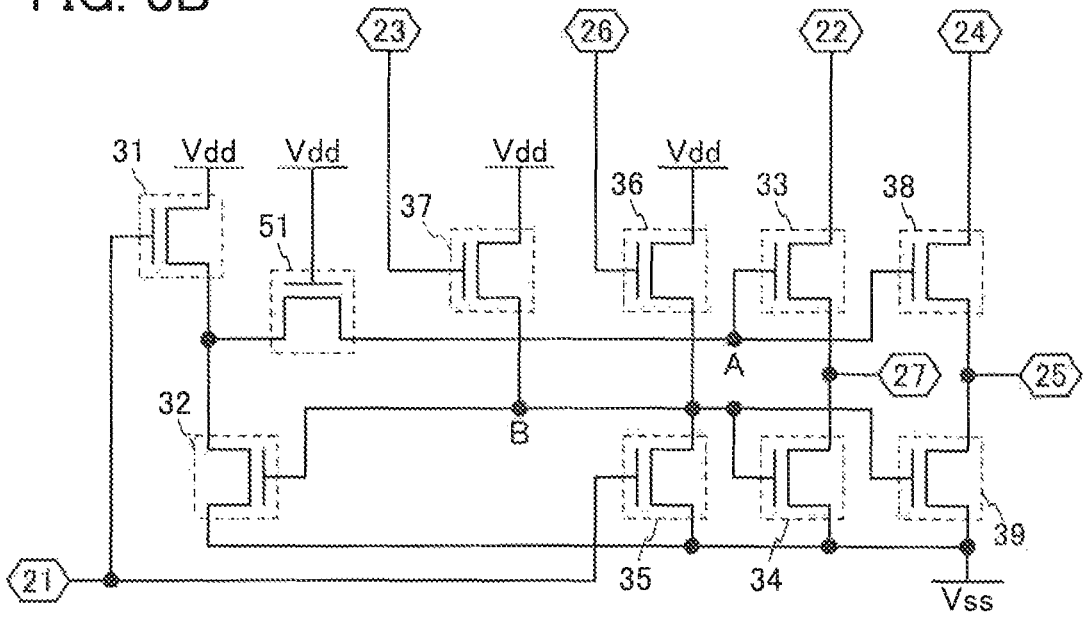

The pulse output circuit in FIG. 8B has a configuration in which a transistor 51 is added to the pulse output circuit in FIG. 3A. One of a source and a drain of the transistor 51 is electrically connected to the other of the source and the drain of the transistor 31 and the other of the source and the drain of the transistor 32; the other of the source and the drain of the transistor 51 is electrically connected to the gate of the transistor 33 and the gate of the transistor 38; and a gate of the transistor 51 is electrically connected to the high power supply potential line. Note that the transistor 51 is off in a period when the node A has a high-level potential (the periods t1 to t6 in FIG. 3B). Therefore, the configuration in which the transistor 51 is added makes it possible to interrupt electrical connections between the gate of the transistor 33 and the gate of the transistor 38 and between the other of the source and the drain of the transistor 31 and the other of the source and the drain of the transistor 32 in the periods t1 to t6. Thus, a load during the bootstrapping in the pulse output circuit can be reduced in a period included in the periods t1 to t6.

Figure 9A:
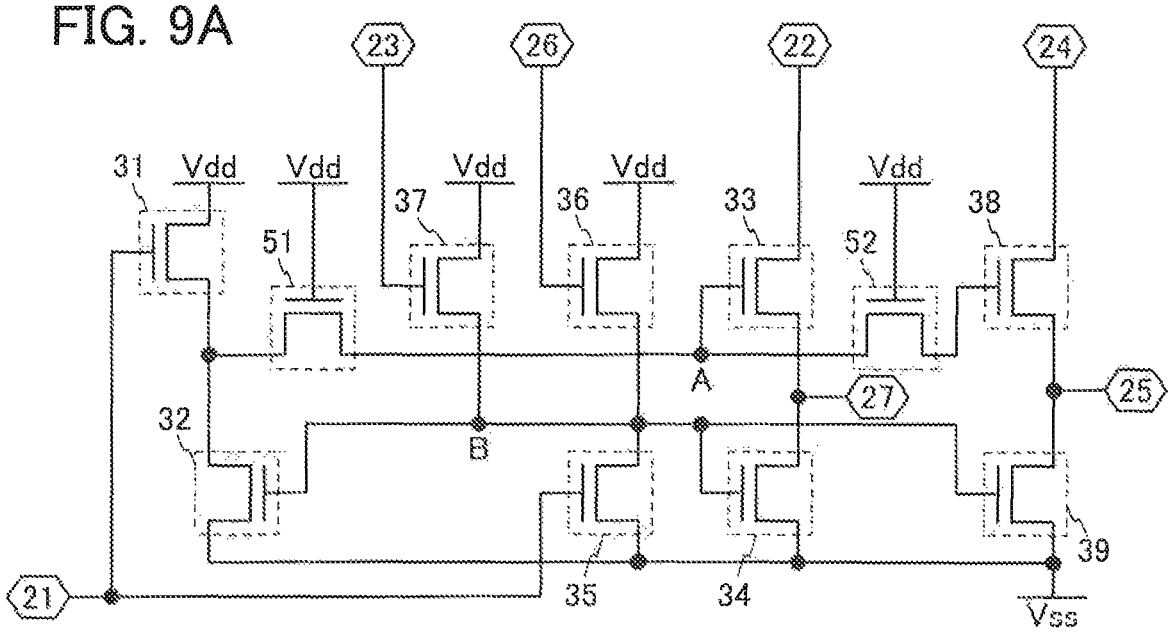
FIGS. 9A and 9B illustrate variations of a pulse output circuit.

The pulse output circuit in FIG. 9A has a configuration in which a transistor 52 is added to the pulse output circuit illustrated in FIG. 8B. One of a source and a drain of the transistor 52 is electrically connected to the gate of the transistor 33 and the other of the source and the drain of the transistor 51; the other of the source and the drain of the transistor 52 is electrically connected to the gate of the transistor 38; and a gate of the transistor 52 is electrically connected to the high power supply potential line. In a manner similar to the above, a load during the bootstrapping in the pulse output circuit can be reduced with the transistor 52.

Figure 9B:
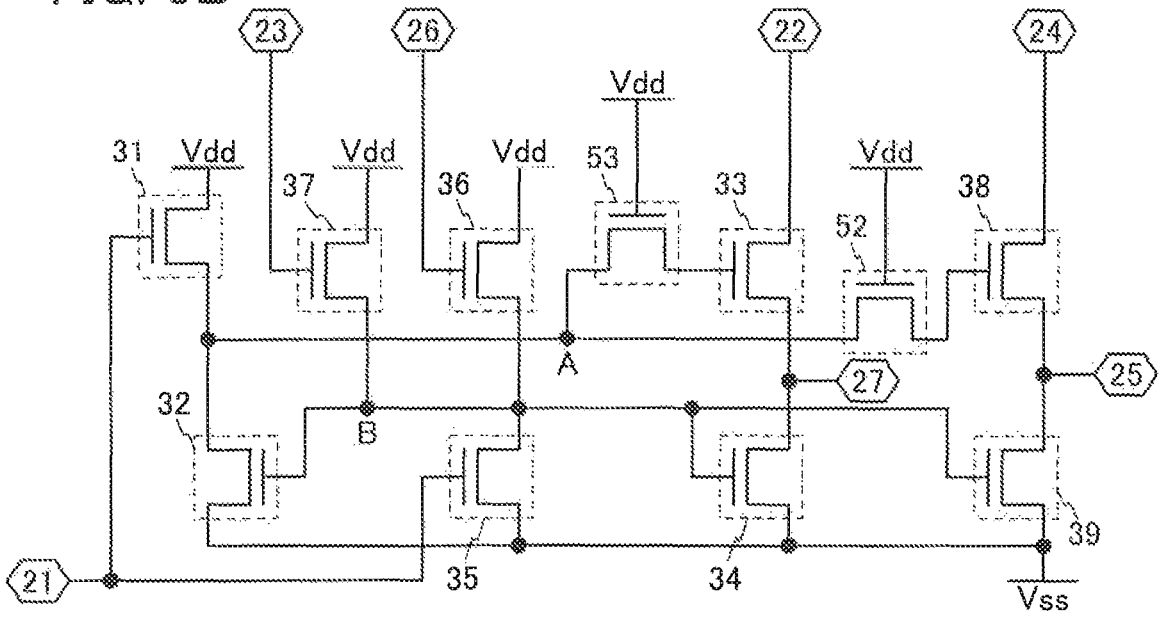

The pulse output circuit in FIG. 9B has a configuration in which the transistor 51 is removed from the pulse output circuit illustrated in FIG. 9A and a transistor 53 is added to the pulse output circuit illustrated in FIG. 9A. One of a source and a drain of the transistor 53 is electrically connected to the other of the source and the drain of the transistor 31, the other of the source and the drain of the transistor 32, and the one of the source and the drain of the transistor 52; the other of the source and the drain of the transistor 53 is electrically connected to the gate of the transistor 33; and a gate of the transistor 53 is electrically connected to the high power supply potential line. In a manner similar to the above, a load during the bootstrapping in the pulse output circuit can be reduced with the transistor 53. Further, an effect of a fraud pulse generated in the pulse output circuit on the switching of the transistors 33 and 38 can be decreased.

[Variations of the Inversed Pulse Output Circuit]

The configuration of the inverted pulse output circuit included in the above scan line driver circuit is not limited to that in FIG. 3C. For example, any of inverted pulse output circuits in FIGS. 10A to 10C can be used as the inverted pulse output circuit included in the above scan line driver circuit.

Figure 10A:
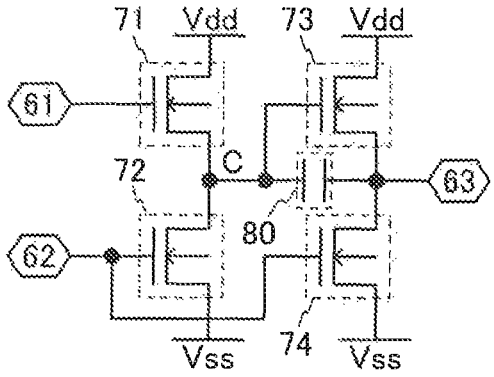
FIGS. 10A to 10C illustrate variations of an inverted pulse output circuit.

The inverted pulse output circuit in FIG. 10A has a configuration in which a capacitor 80 is added to the inverted pulse output circuit in FIG. 3C. One electrode of the capacitor 80 is electrically connected to the other of the source and the drain of the transistor 71, the other of the source and the drain of the transistor 72, and the gate of the transistor 73; and the other electrode of the capacitor 80 is electrically connected to the terminal 63. Note that the capacitor 80 can prevent the potential of the gate of the transistor 73 from changing. On the other hand, the inverted pulse output circuit in FIG. 3C can have a smaller circuit area than the inverted pulse output circuit in FIG. 10A.

Figure 10B:
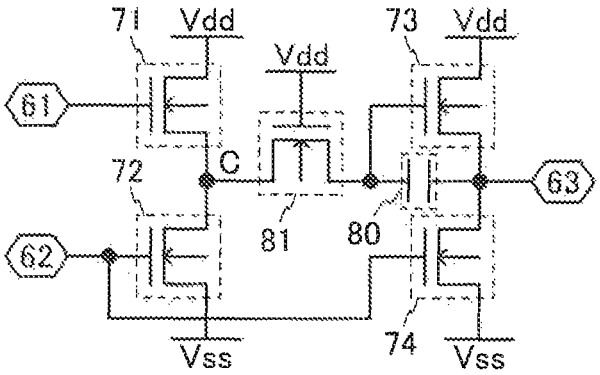

The inverted pulse output circuit in FIG. 10B has a configuration in which a transistor 81 is added to the inverted pulse output circuit in FIG. 10A. One of a source and a drain of the transistor 81 is electrically connected to the other of the source and the drain of the transistor 71 and the other of the source and the drain of the transistor 72; the other of the source and the drain of the transistor 81 is electrically connected to the gate of the transistor 73 and the one electrode of the capacitor 80; and a gate of the transistor 81 is electrically connected to the high power supply potential line. Note that the transistor 81 can prevent breakdown of the transistors 71 and 72. Specifically, in the inverted pulse output circuit in FIG. 3C, the potential of the node C changes significantly owing to the bootstrapping, so that voltages between the sources and the drains of the transistors 71 and 72 (especially between the source and the drain of the transistor 72) change significantly, which may result in the breakdown of the transistors 71 and 72. In contrast, in the inverted pulse output circuit in FIG. 10B, when the potential of the gate of the transistor 73 is increased by the bootstrapping, the transistor 81 is off, so that the potential of the node C does not change significantly owing to the bootstrapping. As a result, it is possible to reduce the change in the voltages between the sources and the drains of the transistors 71 and 72. On the other hand, the inverted pulse output circuit in FIG. 3C or FIG. 10A can have a smaller circuit area than the inverted pulse output circuit in FIG. 10B.

Figure 10C:
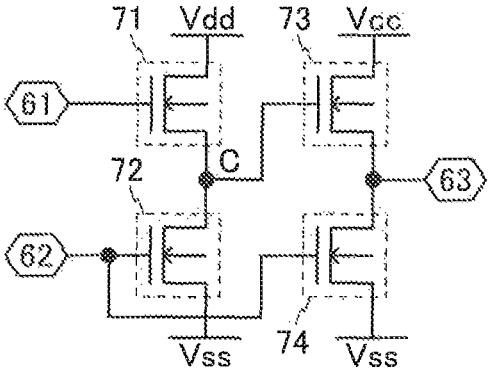

The inverted pulse output circuit in FIG. 10C has such a configuration that the wiring electrically connected to the one of the source and the drain of the transistor 73 is changed from the high power supply potential line to a wiring for supplying a power supply potential (Vcc) in the inverted pulse output circuit in FIG. 3C. Here, the power supply potential (Vcc) is higher than the low power supply potential (Vss) and lower than the high power supply potential (Vdd). Further, this change can reduce the probability that a potential output from the inverted pulse output circuit to the corresponding inverted scan line changes. Furthermore, it can prevent the above breakdown. On the other hand, in the inverted pulse output circuit in FIG. 3C, the number of power supply potentials necessary for the operation of the inverted pulse output circuit can be smaller than in the inverted pulse output circuit in FIG. 10C.

[Variations of the Pixel]

The configuration of the pixel included in the above display device is not limited to that in FIG. 4A. For example, although the pixel in FIG. 4A is formed using only n-channel transistors, the invention is not limited to this configuration. That is, in the display device according to one embodiment of the invention, the pixel can alternatively be formed using only p-channel transistors or n-channel transistors and p-channel transistors in combination.

Note that, as illustrated in FIG. 4A, when the transistors provided in the pixel are of only one conductivity type, the pixels can be highly integrated. This is because in the case where different conductivity types are given to transistors by implanting impurities to semiconductor layers, a gap (margin) needs to be provided between an n-channel transistor and a p-channel transistor. In contrast, the gap is unnecessary in the case where the pixel is formed using transistors of only one conductivity type.

[Specific Examples of the Transistor]

The following shows specific examples of the transistor included in the above-described scan line driver circuit with reference to FIGS. 11A to 11D and FIGS. 12A to 12D. Note that any of the transistors described below can be included in both the scan line driver circuit and the pixel.

A channel formation region of the transistor can be formed using any semiconductor material; for example, a semiconductor material containing a Group 14 element such as silicon or silicon germanium, a semiconductor material containing a metal oxide, or the like can be used. Further, any of the semiconductor materials can be amorphous or crystalline.

Any oxide semiconductor material can also be used, and an oxide semiconductor containing at least one selected from In, Ga, Sn, and Zn is preferably used. For example, an In—Sn—Zn—O-based oxide is preferably used as the oxide semiconductor because a transistor having high field-effect mobility and high reliability can be obtained. This rule also applies to the following oxides: a four-component metal oxide, such as an In—Sn—Ga—Zn—O-based oxide; a three-component metal oxide, such as an In—Ga—Zn—O-based oxide (also referred to as IGZO), an In—Al—Zn—O-based oxide, a Sn—Ga—Zn—O-based oxide, an Al—Ga—Zn—O-based oxide, a Sn—Al—Zn—O-based oxide, an In—Hf—Zn—O-based oxide, an In—La—Zn—O-based oxide, an In—Ce—Zn—O-based oxide, an In—Pr—Zn—O-based oxide, an In—Nd—Zn—O-based oxide, an In—Pm—Zn—O-based oxide, an In—Sm—Zn—O-based oxide, an In—Eu—Zn—O-based oxide, an In—Gd—Zn—O-based oxide, an In—Tb—Zn—O-based oxide, an In—

Dy—Zn—O-based oxide, an In—Ho—Zn—O-based oxide, an In—Er—Zn—O-based oxide, an In—Tm—Zn—O-based oxide, an In—Yb—Zn—O-based oxide, or an In—Lu—Zn—O-based oxide; a two-component metal oxide, such as an In—Zn—O-based oxide, a Sn—Zn—O-based oxide, an Al—Zn—O-based oxide, a Zn—Mg—O-based oxide, a Sn—Mg—O-based oxide, an In—Mg—O-based oxide, or an In—Ga—O-based oxide; a single-component metal oxide, such as an In—O-based oxide, a Sn—O-based oxide, or a Zn—O-based oxide; and the like.

FIGS. 11A to 11D and FIGS. 12A to 12D illustrate specific examples of a transistor in which a channel is formed in an oxide semiconductor. Note that FIGS. 11A to 11D and FIGS. 12A to 12D illustrate specific examples of a bottom-gate transistor, but a top-gate transistor can also be used as the transistor. Further, FIGS. 11A to 11D and FIGS. 12A to 12D illustrate specific examples of a staggered transistor, but a coplanar transistor can also be used as the transistor.

FIGS. 11A to 11D are cross-sectional views illustrating steps for manufacturing a transistor (so-called channel-etched transistor).

First, a conductive film is formed over a substrate 400 which is a substrate having an insulating surface, and then a gate electrode layer 401 is provided by a photolithography step using a photomask.

As the substrate 400, a glass substrate which enables mass production is particularly preferably used. As a glass substrate used for the substrate 400, a glass substrate whose strain point is higher than or equal to 730° C. may be used when the temperature of heat treatment to be performed in a later step is high. For the substrate 400, for example, a glass material such as aluminosilicate glass, aluminoborosilicate glass, or barium borosilicate glass is used.

An insulating layer serving as a base layer may be provided between the substrate 400 and the gate electrode layer 401. The base layer has a function of preventing diffusion of an impurity element from the substrate 400, and can be formed with a single-layer or a stacked-layer structure using one or more of a silicon nitride layer, a silicon oxide layer, a silicon nitride oxide layer, and a silicon oxynitride layer.

Silicon oxynitride refers to silicon in which the content of oxygen is higher than that of nitrogen; for example, silicon oxynitride contains 50 atomic % to 70 atomic % oxygen, 0.5 atomic % to 15 atomic % nitrogen, 25 atomic % to 35 atomic % silicon, and 0 atomic % to 10 atomic % hydrogen. In addition, silicon nitride oxide refers to silicon in which the content of nitrogen is higher than that of oxygen; for example, silicon nitride oxide contains 5 atomic % to 30 atomic % oxygen, 20 atomic % to 55 atomic % nitrogen, 25 atomic % to 35 atomic % silicon, and 10 atomic % to 25 atomic % hydrogen. Note that the above ranges are measured by Rutherford backscattering spectrometry (RBS) or hydrogen forward scattering spectrometry (HFS). Moreover, the total of the percentages of the constituent elements does not exceed 100 atomic %.

The gate electrode layer 401 may be formed with a single-layer or stacked-layer structure using at least one of the following materials: Al, Ti, Cr, Co, Ni, Cu, Y, Zr, Mo, Ag, Ta, and W, a nitride thereof, an oxide thereof, and an alloy thereof. Alternatively, an oxide or an oxynitride containing at least In and Zn may be used. For example, an In—Ga—Zn—O—N-based material may be used.

Next, a gate insulating layer 402 is formed over the gate electrode layer 401. After the gate electrode layer 401 is formed, the gate insulating layer 402 is formed without exposure to the air, by a sputtering method, an evaporation method, a plasma chemical vapor deposition (PCVD) method, a pulsed laser deposition (PLD) method, an atomic layer deposition (ALD) method, a molecular beam epitaxy (MBE) method, or the like.

The gate insulating layer 402 is preferably an insulating film that releases oxygen by heat treatment.

To release oxygen by heat treatment means that the amount of released oxygen which is converted into oxygen atoms is greater than or equal to $1.0\times10^{18}$ atoms/cm$^3$, preferably greater than or equal to $3.0\times10^{20}$ atoms/cm$^3$ in a thermal desorption spectrometry (TDS) analysis.

The following shows a method in which the amount of released oxygen is measured by being converted into oxygen atoms using TDS analysis.

The amount of released gas in TDS analysis is proportional to the integral value of a spectrum. Therefore, the amount of released gas can be calculated from the ratio between the integral value of a measured spectrum and the reference value of a standard sample. The reference value of a standard sample refers to the ratio of the density of a predetermined atom contained in a sample to the integral value of a spectrum.

For example, the number of released oxygen molecules ($N_{O2}$) from an insulating film can be found according to an equation (1) with the TDS analysis results of a silicon wafer containing hydrogen at a predetermined density which is the standard sample and the TDS analysis results of the insulating film. Here, all spectra having a mass number of 32 which are obtained by the TDS analysis are assumed to originate from an oxygen molecule. $CH_3OH$, which is given as a gas having a mass number of 32, is not taken into consideration on the assumption that it is unlikely to be present. Further, an oxygen molecule including an oxygen atom having a mass number of 17 or 18 which is an isotope of an oxygen atom is not taken into consideration either because the proportion of such a molecule in the natural world is minimal.

[Equation 1]

$$N_{O2} = \frac{N_{H2}}{S_{H2}} \times S_{O2} \times \alpha \quad (1)$$

In the equation (1), $N_{H2}$ is the value obtained by conversion of the number of hydrogen molecules released from the standard sample into density. $S_{H2}$ is the integral value of a spectrum when the standard sample is subjected to TDS analysis. Here, the reference value of the standard sample is set to $N_{H2}/S_{H2}$. $S_{O2}$ is the integral value of a spectrum when the insulating film is subjected to TDS analysis. $\alpha$ is a coefficient affecting the intensity of the spectrum in the TDS analysis. Refer to Japanese Published Patent Application No. H06-275697 for details of the equation 1. Note that the amount of released oxygen from the above insulating film is measured with a thermal desorption spectrometer produced by ESCO Ltd., EMD-WA 1000S/W, using a silicon wafer containing hydrogen atoms at $1\times10^{16}$ atoms/cm$^3$ as the standard sample.

Further, in the TDS analysis, oxygen is partly detected as an oxygen atom. The ratio between oxygen molecules and oxygen atoms can be calculated from the ionization rate of the oxygen molecules. Note that, since the above a includes the ionization rate of the oxygen molecules, the number of released oxygen atoms can also be estimated through the evaluation of the number of released oxygen molecules.

Note that $N_{O2}$ is the number of the released oxygen molecules. The amount of released oxygen when converted into oxygen atoms is twice the number of the released oxygen molecules.

In the above structure, the film from which oxygen is released by heat treatment may be oxygen-excess silicon oxide ($SiO_X$(X>2)). In the oxygen-excess silicon oxide ($SiO_X$(X>2)), the number of oxygen atoms per unit volume is more than twice the number of silicon atoms per unit volume. The number of silicon atoms and the number of oxygen atoms per unit volume are measured by Rutherford backscattering spectrometry.

The supply of oxygen from the gate insulating layer 402 to an oxide semiconductor film can reduce interface state density therebetween. As a result, carriers can be prevented from being trapped at the interface between the oxide semiconductor film and the gate insulating layer 402, so that electrical characteristics of the transistor hardly degrade.

Further, in some cases, charge is generated owing to oxygen vacancy in the oxide semiconductor film. In general, part of the oxygen vacancy in the oxide semiconductor film serves as a donor and causes release of an electron which is a carrier. As a result, the threshold voltage of the transistor shifts in the negative direction. To prevent this, sufficient oxygen, preferably excessive oxygen, is supplied from the gate insulating layer 402 to the oxide semiconductor film which is in contact with the gate insulating layer 402, so that the oxygen vacancy in the oxide semiconductor film causing the shift of the threshold voltage in the negative direction can be reduced.

The gate insulating layer 402 is preferably sufficiently flat so that crystal growth of the oxide semiconductor film can be easy.

The gate insulating layer 402 may be formed with a single-layer or stacked-layer structure using at least one of the following materials: silicon oxide, silicon oxynitride, silicon nitride oxide, silicon nitride, aluminum oxide, aluminum nitride, hafnium oxide, zirconium oxide, yttrium oxide, lanthanum oxide, cesium oxide, tantalum oxide, and magnesium oxide.

The gate insulating layer 402 is preferably formed by a sputtering method in an oxygen gas atmosphere at a substrate heating temperature of higher than or equal to room temperature and lower than or equal to 200° C., preferably higher than or equal to 50° C. and lower than or equal to 150° C. Note that a rare gas may be added to the oxygen gas; in that case, the percentage of the oxygen gas is 30 vol. % or higher, preferably 50 vol. % or higher, more preferably 80 vol. % or higher. The thickness of the gate insulating layer 402 ranges from 100 nm to 1000 nm, preferably 200 nm to 700 nm. Lower substrate heating temperature at the time of film formation, higher percentage of the oxygen gas in a film formation atmosphere, or a larger thickness of the gate insulating layer 402 leads to a larger amount of oxygen released at the time of performing heat treatment on the gate insulating layer 402. The concentration of hydrogen in a film can be more reduced by a sputtering method than a PCVD method. Note that the gate insulating layer 402 may have a thickness greater than 1000 nm, but has a thickness such that productivity is not reduced.

Figure 11A:
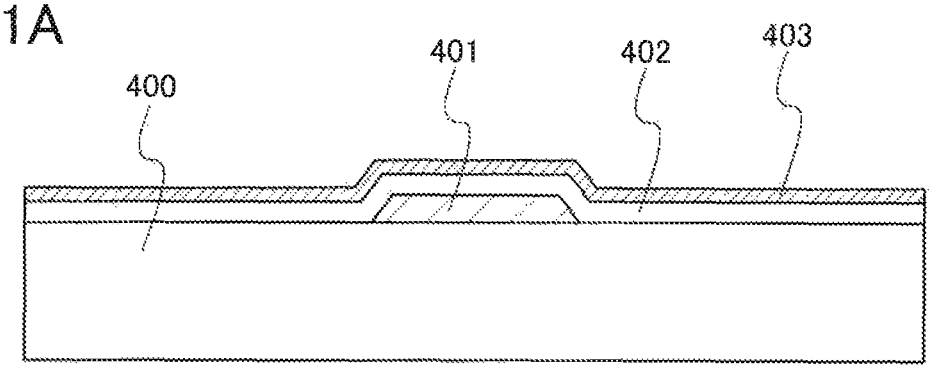
FIGS. 11A to 11D are cross-sectional views illustrating a specific example of a transistor.

Then, over the gate insulating layer 402, an oxide semiconductor film 403 is formed by a sputtering method, an evaporation method, a PCVD method, a PLD method, an ALD method, an MBE method, or the like. FIG. 11A is a cross-sectional view after the above steps.

The oxide semiconductor film 403 has a thickness ranging from 1 nm to 40 nm, preferably from 3 nm to 20 nm. In particular, in the case where the transistor has a channel length of 30 nm or less and the oxide semiconductor film 403 has a thickness of approximately 5 nm, a short channel effect can be suppressed and stable electrical characteristics can be obtained.

In particular, a transistor in which an In—Sn—Zn—O-based material is used for the oxide semiconductor film 403 can have high field-effect mobility.

A transistor in which a channel is formed in an oxide semiconductor film containing In, Sn, and Zn as main components can have favorable characteristics by forming the oxide semiconductor film while heating the substrate or by performing heat treatment after the oxide semiconductor film is formed. Note that a main component refers to an element contained in composition at 5 atomic % or more.

By intentionally heating the substrate after formation of the oxide semiconductor film containing In, Sn, and Zn as main components, the field-effect mobility of the transistor can be improved. Further, the threshold voltage of the transistor can be positively shifted to make the transistor normally off.

The oxide semiconductor film 403 is formed using a material with a band gap of 2.5 eV or more, preferably 2.8 eV or more, more preferably 3.0 eV or more, in order to reduce the off-state current of the transistor. With the use of a material with a band gap in the above range for the oxide semiconductor film 403, the off-state current of the transistor can be reduced.

In the oxide semiconductor film 403, it is preferable that hydrogen, alkali metals, alkaline earth metals, and the like be reduced so that the concentration of impurities is extremely low. This is because the above impurities contained in the oxide semiconductor film 403 form levels which cause recombination in the band gap, resulting in an increase in the off-state current of the transistor.

The concentration of hydrogen in the oxide semiconductor film 403, which is measured by secondary ion mass spectrometry (SIMS), is lower than $5\times10^{19}$ $cm^{-3}$, preferably lower than or equal to $5\times10^{18}$ $cm^{-3}$, more preferably lower than or equal to $1\times10^{18}$ $cm^{-3}$, still more preferably lower than or equal to $5\times10^{17}$ $cm^{-3}$.

Further, the concentration of alkali metals in the oxide semiconductor film 403 measured by SIMS is as follows. The concentration of sodium is lower than or equal to $5\times10^{16}$ $cm^{-3}$, preferably lower than or equal to $1\times10^{16}$ $cm^{-3}$, more preferably lower than or equal to $1\times10^{15}$ $cm^{-3}$. Similarly, the concentration of lithium is lower than or equal to $5\times10^{15}$ $cm^{-3}$, preferably lower than or equal to $1\times10^{15}$ $cm^{-3}$. Similarly, the concentration of potassium is lower than or equal to $5\times10^{15}$ $cm^{-3}$, preferably lower than or equal to $1\times10^{15}$ $cm^{-3}$.

As the oxide semiconductor film 403, an oxide semiconductor film (also referred to as c-axis aligned crystalline oxide semiconductor film (CAAC-OS film)) including a crystal (also referred to as c-axis aligned crystal (CAAC)), which is aligned along the c-axis and has a triangular or hexagonal atomic arrangement when seen from the direction of the a-b plane, a top surface, or an interface may be used. In the crystal, metal atoms are arranged in a layered manner along the c-axis, or metal atoms and oxygen atoms are arranged in a layered manner along the c-axis, and the direction of the a-axis or the b-axis is varied in the a-b plane (the crystal twists around the c-axis).

In a broad sense, a CAAC means a non-single-crystal including a phase which has a triangular, hexagonal, regular triangular, or regular hexagonal atomic arrangement when seen from the direction perpendicular to the a-b plane and in which metal atoms are arranged in a layered manner or metal atoms and oxygen atoms are arranged in a layered manner when seen from the direction perpendicular to the c-axis direction. Note that nitrogen may be substituted for part of oxygen contained in the CAAC.

The CAAC-OS film is not a single crystal, but this does not mean that the CAAC-OS film is composed of only an amorphous component. Although the CAAC-OS film includes a crystallized portion (crystalline portion), a boundary between one crystalline portion and another crystalline portion is not clear in some cases. The c-axes of the crystalline portions included in the CAAC-OS film may be aligned in one direction (e.g., a direction perpendicular to a surface of a substrate over which the CAAC-OS film is formed or a top surface of the CAAC-OS film). Alternatively, the normals to the a-b planes of the individual crystalline portions included in the CAAC-OS film may be aligned in a certain direction (e.g., a direction perpendicular to a surface of a substrate over which the CAAC-OS film is formed or a surface of the CAAC-OS film). As an example of such a CAAC-OS film, there is an oxide film which is formed into a film shape and has a triangular or hexagonal atomic arrangement when seen from the direction perpendicular to a surface of the film or a surface of a substrate over which the CAAC-OS film is formed, and in which metal atoms are arranged in a layered manner or metal atoms and oxygen atoms (or nitrogen atoms) are arranged in a layered manner when a cross section of the film is seen.

The oxide semiconductor film 403 is formed preferably by a sputtering method in an oxygen gas atmosphere at a substrate heating temperature from 100° C. to 600° C., preferably from 150° C. to 550° C., more preferably from 200° C. to 500° C. The thickness of the oxide semiconductor film 403 is from 1 nm to 40 nm, preferably from 3 nm to 20 nm. The higher the substrate heating temperature at the time of film formation is, the lower the impurity concentration in the obtained oxide semiconductor film 403 is. Further, the atomic arrangement in the oxide semiconductor film 403 is ordered, the density thereof is increased, so that a crystal or a CAAC is easily formed. Furthermore, since an oxygen gas atmosphere is employed for the film formation, an unnecessary atom such as a rare gas atom is not contained in the oxide semiconductor film 403, so that a crystal or a CAAC is easily formed. Note that a mixed gas atmosphere including an oxygen gas and a rare gas may be used. In that case, the percentage of an oxygen gas is 30 vol. % or higher, preferably 50 vol. % or higher, more preferably 80 vol. % or higher. The thinner the oxide semiconductor film 403 is, the lower the short channel effect of the transistor is. However, when the oxide semiconductor film 403 is too thin, the oxide semiconductor film 403 is significantly influenced by interface scattering; thus, the field-effect mobility might be decreased.

In the case of forming a film of an In—Sn—Zn—O-based material as the oxide semiconductor film 403 by a sputtering method, it is preferable to use an In—Sn—Zn—O target having an atomic ratio of In:Sn:Zn=2:1:3, 1:2:2, 1:1:1, or 20:45:35. When the oxide semiconductor film 403 is formed using an In—Sn—Zn—O target having the aforementioned composition ratio, a crystal or a CAAC is easily formed.

Figure 11B:
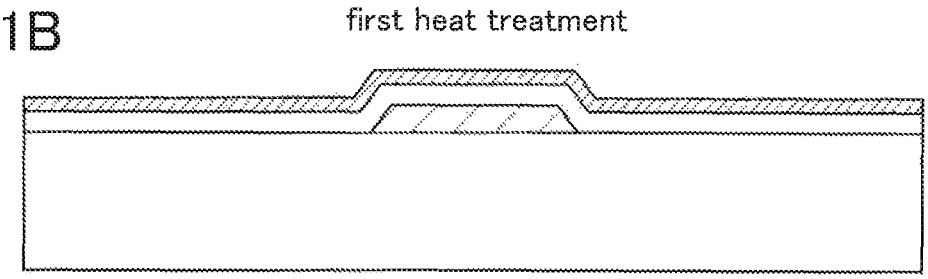

Next, first heat treatment is performed. The first heat treatment is performed in a reduced pressure atmosphere, an inert atmosphere, or an oxidation atmosphere. By the first heat treatment, the impurity concentration in the oxide semiconductor film 403 can be reduced. FIG. 11B is a cross-sectional view after the above steps.

The first heat treatment is preferably performed in such a manner that heat treatment in a reduced pressure atmosphere or an inert atmosphere is completed and then, the atmosphere is changed to an oxidation atmosphere while the temperature is kept, and heat treatment is further performed. By the heat treatment performed in a reduced pressure atmosphere or an inert atmosphere, the impurity concentration in the oxide semiconductor film 403 can be effectively reduced; at the same time, oxygen vacancy is generated. Therefore, the heat treatment in the oxidation atmosphere is performed so as to reduce the generated oxygen vacancy.

By performing the first heat treatment in addition to the substrate heating at the time of film formation on the oxide semiconductor film 403, the number of the impurity levels in the film can be significantly reduced. As a result, the field-effect mobility of the transistor can be increased to close to the later-described ideal field-effect mobility.

Note that oxygen ions may be implanted into the oxide semiconductor film 403 and impurities such as hydrogen may be released from the oxide semiconductor film 403 by heat treatment so that the oxide semiconductor film 403 can be crystallized at the same time as the heat treatment or by heat treatment performed later.

The oxide semiconductor film 403 may be selectively crystallized by laser beam irradiation instead of the first heat treatment. Alternatively, the laser beam irradiation may be performed while the first heat treatment is performed so that the oxide semiconductor film 403 can be crystallized selectively. The laser beam irradiation is performed in an inert atmosphere, an oxidation atmosphere, or a reduced pressure atmosphere. A continuous wave laser beam (hereinafter referred to as CW laser beam) or a pulsed wave laser beam (hereinafter referred to as pulsed laser beam) can be used in the case of the laser beam irradiation. For example, it is possible to use a gas laser beam such as an Ar laser beam, a Kr laser beam, or an excimer laser beam; a laser beam emitted using, as a medium, single crystal or polycrystalline YAG; $YVO_4$, forsterite ($Mg_2SiO_4$), $YAlO_3$, or $GdVO_4$ doped with one or more of Nd, Yb, Cr, Ti, Ho, Er, Tm, and Ta as a dopant; a solid-state laser beam such as a glass laser beam, a ruby laser beam, an alexandrite laser beam, or a Ti:sapphire laser beam; or a vapor laser beam emitted using one or both of copper vapor and gold vapor. By irradiation with the fundamental harmonic of such a laser beam or any of the second harmonic to the fifth harmonic of the fundamental harmonic of the laser beam, the oxide semiconductor film 403 can be crystallized. Note that the laser beam used for the irradiation preferably has larger energy than a band gap of the oxide semiconductor film 403. For example, a laser beam emitted from a KrF, ArF, XeCl, or XeF excimer laser may be used. Note that the laser beam may be a linear laser beam.

Note that laser beam irradiation may be performed plural times under different conditions. For example, it is preferable that first laser beam irradiation be performed in a rare gas atmosphere or a reduced-pressure atmosphere, and second laser beam irradiation be performed in an oxidation atmosphere because in that case, high crystallinity can be obtained while oxygen vacancy in the oxide semiconductor film 403 is reduced.

Next, the oxide semiconductor film 403 is processed into an island shape by a photolithography step or the like to form an oxide semiconductor film 404.

Then, a conductive film is formed over the gate insulating layer 402 and the oxide semiconductor film 404, and then a photolithography step or the like is performed to form a source electrode 405A and a drain electrode 405B. The conductive film may be formed by a sputtering method, an evaporation method, a PCVD method, a PLD method, an ALD method, an MBE method, or the like. Like the gate electrode layer 401, the source electrode 405A and the drain electrode 405B may be formed with a single-layer or stacked-layer structure using at least one of the following materials: Al, Ti, Cr, Co, Ni, Cu, Y, Zr, Mo, Ag, Ta, and W, a nitride thereof, an oxide thereof, and an alloy thereof.

Figure 11C:
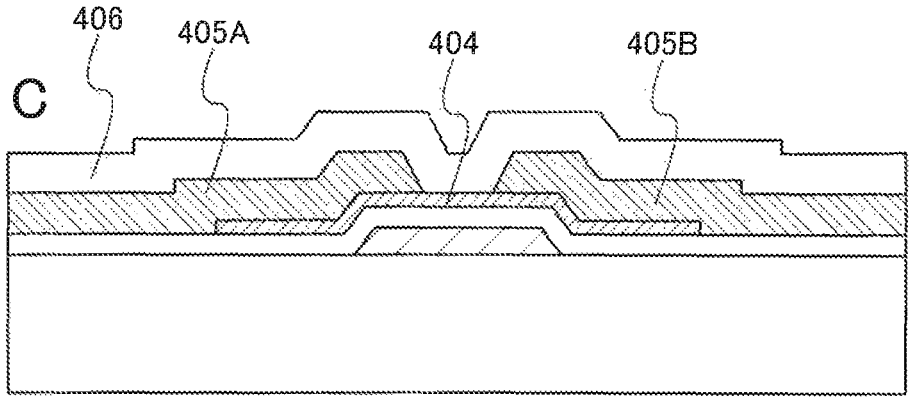

Next, an insulating film 406 serving as a top insulating film is formed by a sputtering method, an evaporation method, a PCVD method, a PLD method, an ALD method, an MBE method, or the like. FIG. 11C is a cross-sectional view after the above steps. The insulating film 406 may be formed by a method similar to that of forming the gate insulating layer 402.

A protective insulating film (not shown) may be formed to be stacked over the insulating film 406. The protective insulating film preferably has a property of preventing oxygen from passing therethrough even when one-hour heat treatment is performed at 250° C. to 450° C., or preferably 150° C. to 800° C., for example.

In the case where the protective insulating film with such a property is provided in the periphery of the insulating film 406, oxygen released from the insulating film 406 by heat treatment can be inhibited from diffusing toward the outside of the transistor. Since oxygen is held in the insulating film 406 in this manner, the field-effect mobility of the transistor can be prevented from decreasing, a variation in the threshold voltage can be reduced, and the reliability can be improved.

The protective insulating film may be formed with a single-layer or stacked-layer structure using at least one of the following materials: silicon nitride oxide, silicon nitride, aluminum oxide, aluminum nitride, hafnium oxide, zirconium oxide, yttrium oxide, lanthanum oxide, cesium oxide, tantalum oxide, and magnesium oxide.

Figure 11D:
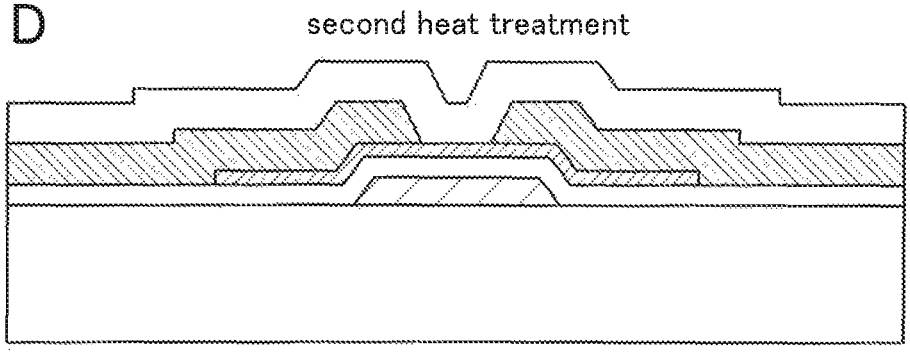

After the insulating film 406 is formed, second heat treatment is performed. FIG. 11D is a cross-sectional view after the above steps. The second heat treatment is performed at 150° C. to 550° C., preferably 250° C. to 400° C. in a reduced pressure atmosphere, an inert atmosphere, or an oxidation atmosphere. The second heat treatment can release oxygen from the gate insulating layer 402 and the insulating film 406, and reduce oxygen vacancy in the oxide semiconductor film 404. Further, interface state density between the gate insulating layer 402 and the oxide semiconductor film 404 and between the oxide semiconductor film 404 and the insulating film 406 can be reduced, resulting in a reduction in variations in the threshold voltage of the transistor and an increase in the reliability of the transistor.

The transistor including the oxide semiconductor film 404 subjected to the first and second heat treatment has high field-effect mobility and low off-state current. Specifically, the off-state current per micrometer of the channel width can be $1\times10^{-18}$ A or lower, $1\times10^{-21}$ A or lower, or $1\times10^{-24}$ A or lower.

The oxide semiconductor film 404 is preferably non-single-crystal. This is because in the case where operation of the transistor or light or heat from the outside generates oxygen vacancy in the oxide semiconductor film 404 which is completely single crystal, a carrier due to the oxygen vacancy is generated in the oxide semiconductor film 404 owing to the absence of oxygen between lattices which repair the oxygen vacancy; as a result, the threshold voltage of the transistor might shift in the negative direction.

The oxide semiconductor film 404 preferably has crystallinity. For example, as the oxide semiconductor film 403, it is preferable to use a polycrystalline oxide semiconductor film or a CAAC-OS film.

Through the above-described steps, the transistor illustrated in FIG. 11D can be manufactured.

A transistor having a different structure from the structure of the above transistor is described with reference to FIGS. 12A to 12D. Note that FIGS. 12A to 12D are cross-sectional views illustrating steps of manufacturing a so-called etching-stop transistor (also referred to as channel-stop transistor and channel-protective transistor).

The transistor illustrated in FIGS. 12A to 12D is different from the transistor illustrated in FIGS. 11A to 11D in that an insulating film 408 serving as an etching-stop film is provided. Therefore, the same description as that for FIGS. 11A to 11D is omitted below, and the above description is to be referred to.

Figure 12A:
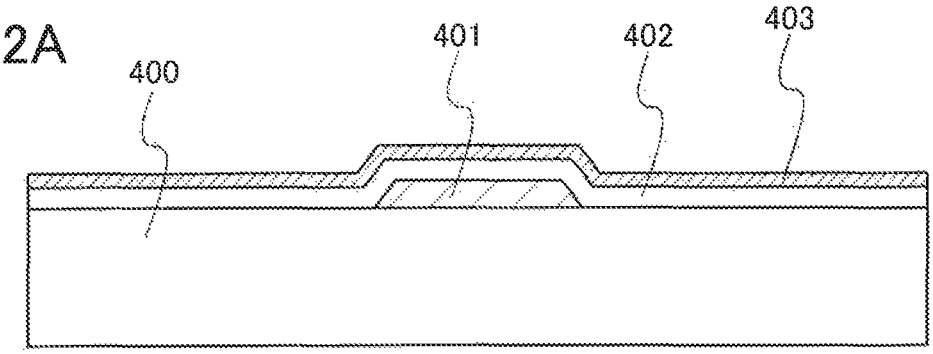
FIGS. 12A to 12D are cross-sectional views illustrating a specific example of a transistor.
Figure 12B:
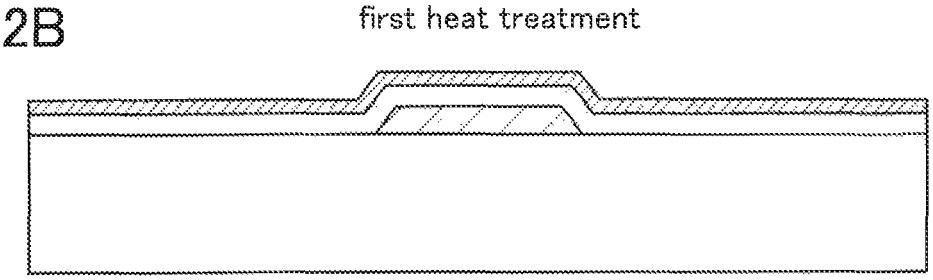

Through the above-described steps, the structure illustrated in the cross-sectional view in FIGS. 12A and 12B can be obtained.

Figure 12C:
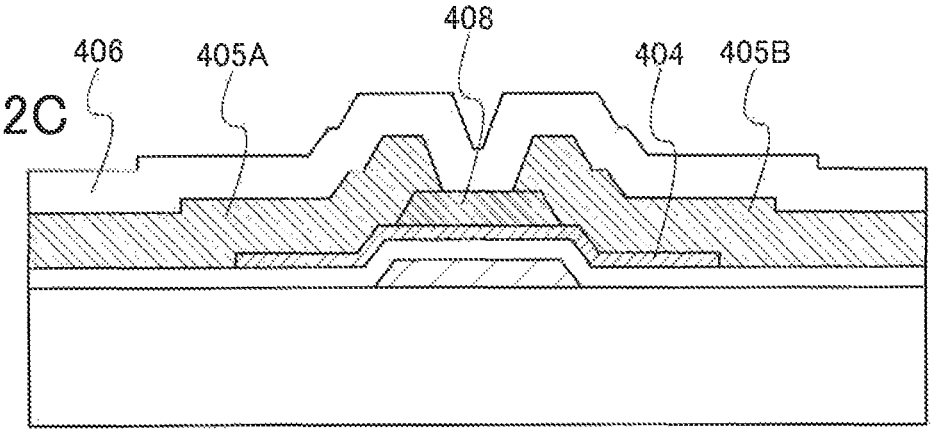

The insulating film 408 in FIG. 12C can be formed in a manner similar to that of forming the gate insulating layer 402 and the insulating film 406. That is, as the insulating film 408, an insulating film from which oxygen is released by heat treatment is preferably used.

The insulating film 408 serving as the etching-stop film can prevent the oxide semiconductor film 404 from being etched in a photolithography step or the like for forming the source electrode 405A and the drain electrode 405B.

Figure 12D:
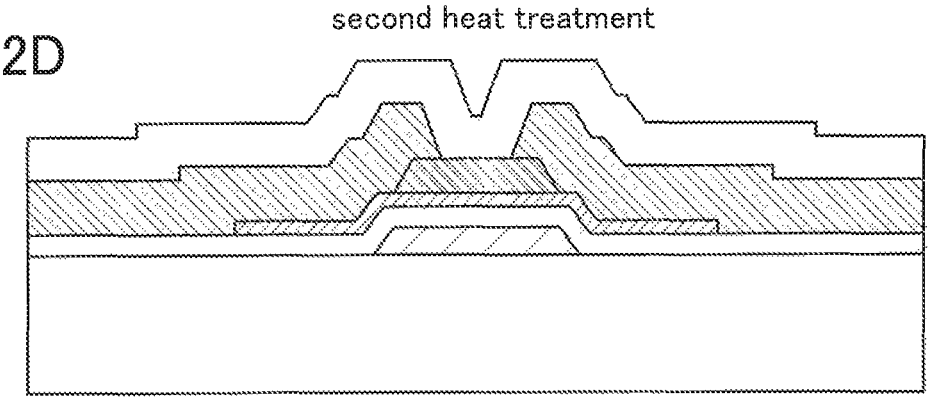

After an insulating film 406 in FIG. 12D is formed, the second heat treatment is performed so that oxygen is released from the insulating film 408 as well as from the insulating film 406. Thus, an effect of reducing oxygen vacancy in the oxide semiconductor film 404 can be further increased. Further, interface state density between the gate insulating layer 402 and the oxide semiconductor film 404 and between the oxide semiconductor film 404 and the insulating film 408 can be reduced, resulting in a reduction in variations in the threshold voltage of the transistor and an increase in the reliability of the transistor.

Through the above-described steps, the transistor illustrated in FIG. 12D can be manufactured.

Figure 13A:
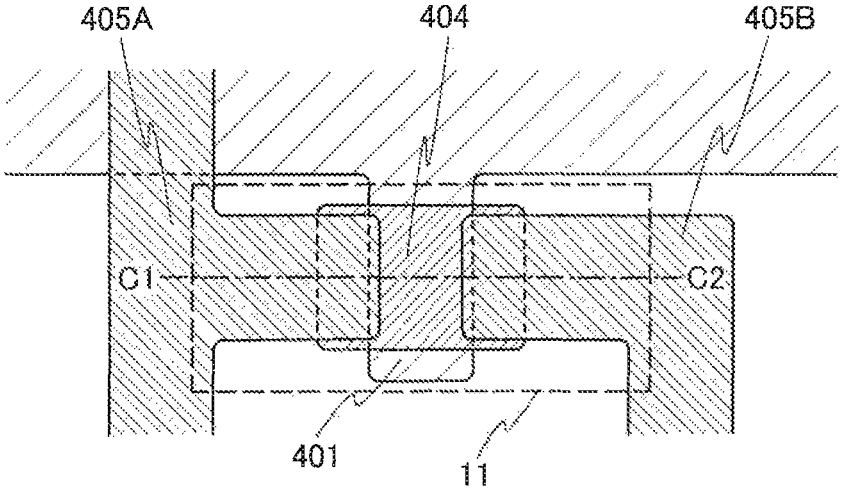
FIGS. 13A and 13B are top views illustrating specific examples of transistors.
Figure 13B:
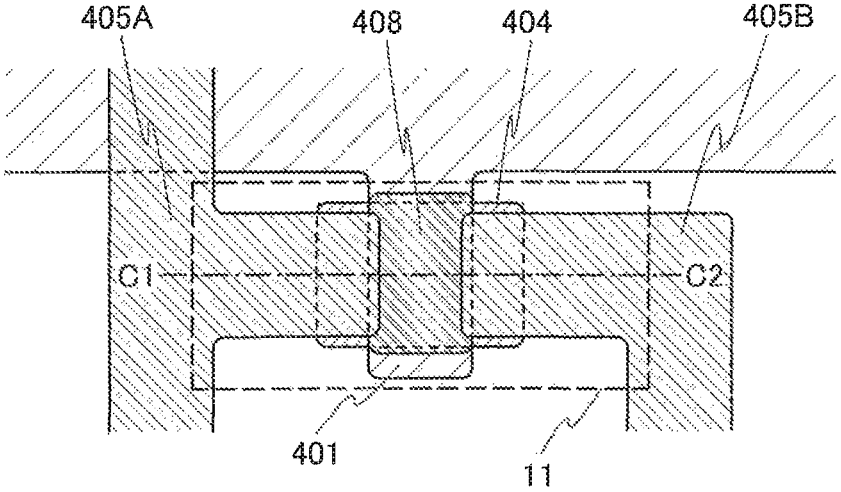

The scan line driver circuit and the pixel can include any of the transistors illustrated in FIG. 11D and FIG. 12D. For example, configurations where the transistor is used as the transistor 11 in FIG. 4A are described with reference to FIGS. 13A and 13B. Specifically, FIG. 13A is a top view in the case where the transistor illustrated in FIG. 11D is used as the transistor 11, and FIG. 13B is a top view in the case where the transistor illustrated in FIG. 12D is used as the transistor 11. Note that a cross section along line C1-C2 in FIG. 13A is FIG. 11D, and a cross section along line C1-C2 in FIG. 13B is FIG. 12D.

In each of the transistors illustrated in FIGS. 13A and 13B, part of a wiring serving as the signal line 6 in FIG. 4A is used as the one of the source and the drain of the transistor 11, and part of a wiring serving as the scan line 4 is used as the gate of the transistor 11. In this manner, parts of the wirings provided in the display device can be used as the terminals of the transistor.

[Various Electronic Devices Including Liquid Crystal Display Device]

The following shows examples of electronic devices each including the liquid crystal display device disclosed in this specification with reference to FIGS. 14A to 14F.

Figure 14A:
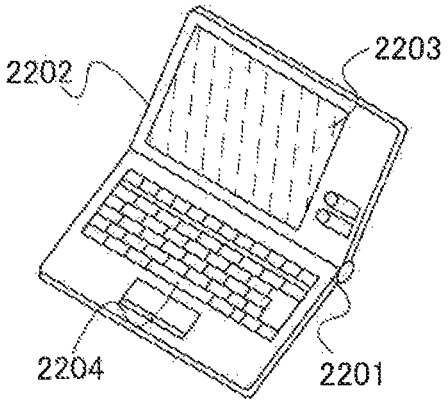
FIGS. 14A to 14F each illustrate an example of an electronic device.

FIG. 14A illustrates a laptop computer which includes a main body 2201, a housing 2202, a display portion 2203, a keyboard 2204, and the like.

Figure 14B:
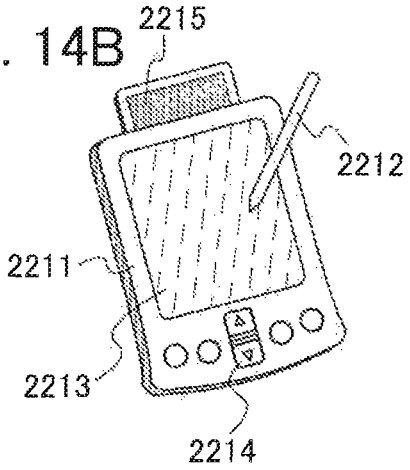

FIG. 14B illustrates a personal digital assistant (PDA), which includes a main body 2211 having a display portion 2213, an external interface 2215, an operation button 2214, and the like. A stylus 2212 for operation is included as an accessory.

Figure 14C:
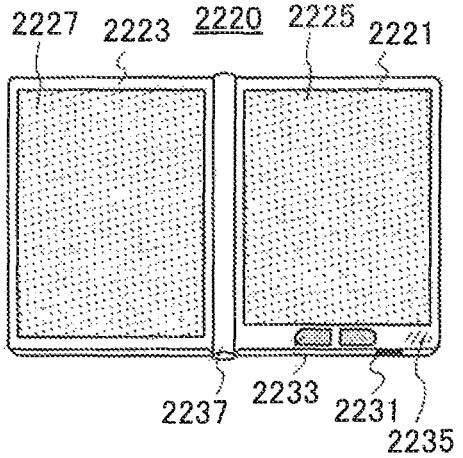

FIG. 14C illustrates an e-book reader 2220 as an example of electronic paper. The e-book reader 2220 includes two housings, a housing 2221 and a housing 2223. The housings 2221 and 2223 are bound with each other by an axis portion 2237, along which the e-book reader 2220 can be opened and closed. With such a structure, the e-book reader 2220 can be used as a paper book.

A display portion 2225 is incorporated in the housing 2221, and a display portion 2227 is incorporated in the housing 2223. The display portion 2225 and the display portion 2227 may display one image or different images. In the structure where the display portions display different images from each other, for example, the right display portion (the display portion 2225 in FIG. 14C) can display text and the left display portion (the display portion 2227 in FIG. 14C) can display images.

Further, in FIG. 14C, the housing 2221 is provided with an operation portion and the like. For example, the housing 2221 is provided with a power supply 2231, an operation key 2233, a speaker 2235, and the like. With the operation key 2233, pages can be turned. Note that a keyboard, a pointing device, or the like may also be provided on the surface of the housing, on which the display portion is provided. Furthermore, an external connection terminal (an earphone terminal, a USB terminal, a terminal that can be connected to various cables such as an AC adapter and a USB cable, or the like), a recording medium insertion portion, and the like may be provided on the back surface or the side surface of the housing. Further, the e-book reader 2220 may have a function of an electronic dictionary.

The e-book reader 2220 may be configured to transmit and receive data wirelessly. Through wireless communication, desired book data or the like can be purchased and downloaded from an electronic book server.

Note that electronic paper can be applied to devices in a variety of fields as long as they display information. For example, electronic paper can be used for posters, advertisement in vehicles such as trains, display in a variety of cards such as credit cards, and the like in addition to e-book readers.

Figure 14D:
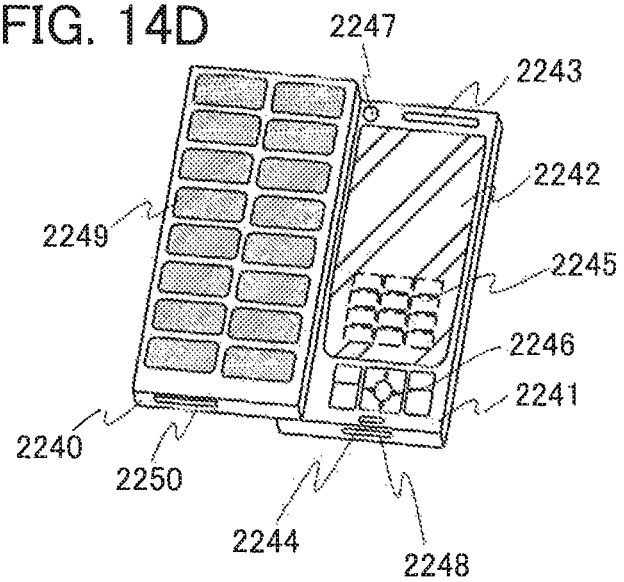

FIG. 14D illustrates a mobile phone. The mobile phone includes two housings: housings 2240 and 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 for charging the mobile phone, an external memory slot 2250, and the like. An antenna is incorporated in the housing 2241.

The display panel 2242 has a touch panel function. A plurality of operation keys 2245 which are displayed as images are illustrated by dashed lines in FIG. 14D. Note that the mobile phone includes a booster circuit for increasing a voltage output from the solar cell 2249 to a voltage needed for each circuit. Moreover, the mobile phone can include a contactless IC chip, a small recording device, or the like in addition to the above structure.

The display orientation of the display panel 2242 changes as appropriate in accordance with the application mode. Further, the camera lens 2247 is provided on the same surface as the display panel 2242, and thus it can be used as a video phone. The speaker 2243 and the microphone 2244 can be used for videophone calls, recording, and playing sound, etc. as well as voice calls. Moreover, the housings 2240 and 2241 in a state where they are developed as illustrated in FIG. 14D can be slid so that one is lapped over the other; therefore, the portable phone can be downsized, which makes the portable phone suitable for being carried.

The external connection terminal 2248 can be connected to an AC adapter or a variety of cables such as a USB cable, which enables charging of the mobile phone and data communication. Moreover, a larger amount of data can be saved and moved by inserting a recording medium to the external memory slot 2250. Further, in addition to the above functions, an infrared communication function, a television reception function, or the like may be provided.

Figure 14E:
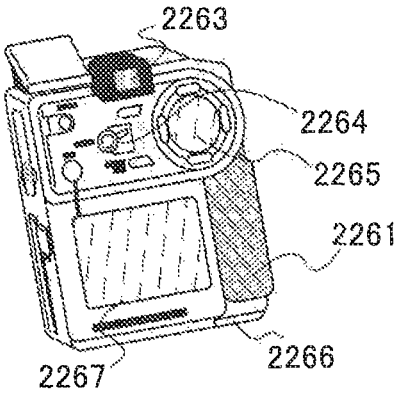

FIG. 14E illustrates a digital camera, which includes a main body 2261, a display portion (A) 2267, an eyepiece 2263, an operation switch 2264, a display portion (B) 2265, a battery 2266, and the like.

Figure 14F:
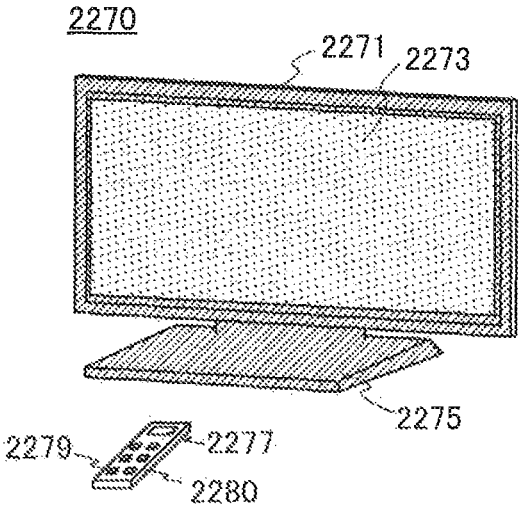

FIG. 14F illustrates a television set. In a television set 2270, a display portion 2273 is incorporated in a housing 2271. The display portion 2273 can display images. Here, the housing 2271 is supported by a stand 2275.

The television set 2270 can be operated by an operation switch of the housing 2271 or a separate remote controller 2280. Channels and volume can be controlled with an operation key 2279 of the remote controller 2280 so that an image displayed on the display portion 2273 can be controlled. Moreover, the remote controller 2280 may have a display portion 2277 in which the information outgoing from the remote controller 2280 is displayed.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

EXPLANATION OF REFERENCE

1: scan line driver circuit, 2: signal line driver circuit, 3: current source, 4: scan line, 5: inverted scan line, 6: signal line, 7: power supply line, 10: pixel, 11: transistor, 12: transistor, 13: transistor, 14: transistor, 15: transistor, 16: transistor, 17: capacitor, 18: organic EL element, 20: pulse output circuit, 21: terminal, 22: terminal, 23: terminal, 24: terminal 25: terminal, 26: terminal, 27: terminal, 31: transistor, 32: transistor, 33: transistor, 34: transistor, 35: transistor, 36: transistor, 37: transistor 38: transistor, 39: transistor, 50: transistor, 51: transistor, 52: transistor, 53: transistor, 60: inverted pulse output circuit, 61: terminal, 62: terminal, 63: terminal, 71: transistor, 72: transistor, 73: transistor, 74: transistor, 80: capacitor, 81: transistor, 400: substrate, 401: gate electrode layer, 402: gate insulating layer, 403: oxide semiconductor film, 404: oxide semiconductor film, 405A: source electrode, 405B: drain electrode, 406: insulating film, 408: insulating film, 2201: main body, 2202: housing, 2203: display portion, 2204: keyboard, 2211: main body, 2212: stylus, 2213: display portion, 2214: operation button, 2215: external interface, 2220: e-book reader, 2221: housing, 2223: housing, 2225: display portion, 2227: display portion, 2231: power supply, 2233: operation key, 2235: speaker, 2237: axis portion, 2240: housing, 2241: housing, 2242: display panel, 2243: speaker, 2244: microphone, 2245: operation key, 2246: pointing device, 2247: camera lens, 2248: external connection terminal, 2249: solar cell, 2250: external memory slot, 2261: main body, 2263: eyepiece, 2264: operation switch, 2265: display portion (B), 2266: battery, 2267: display portion (A), 2270: television set, 2271: housing, 2273: display portion, 2275: stand, 2277: display portion, 2279: operation key, 2280: remote controller.

This application is based on Japanese Patent Application serial no. 2011-108318 filed with Japan Patent Office on May 13, 2011, the entire contents of which are hereby incorporated by reference.

The invention claimed is:

1. A display device comprising:

a pixel comprising:

a first transistor;

a second transistor;

a third transistor;

a fourth transistor;

a fifth transistor;

a sixth transistor;

a capacitor; and an organic electroluminescent element, wherein a gate of the first transistor is electrically connected to a first electrode of the capacitor, wherein one of a source and a drain of the second transistor is electrically connected to the gate of the first transistor, wherein the other of the source and the drain of the second transistor is directly connected to one of a source and a drain of the first transistor, wherein one of a source and a drain of the third transistor is electrically connected to a signal line, wherein the other of the source and the drain of the third transistor is electrically connected to the other of the source and the drain of the first transistor, wherein one of a source and a drain of the fourth transistor is electrically connected to a power supply line, wherein the other of the source and the drain of the fourth transistor is electrically connected to the one of the source and the drain of the first transistor, wherein one of a source and a drain of fifth transistor is electrically connected to the organic electroluminescent element, wherein the other of the source and the drain of the fifth transistor is electrically connected to the other of the source and the drain of the first transistor, wherein one of a source and a drain of the sixth transistor is electrically connected to the organic electroluminescent element, wherein a second electrode of the capacitor is electrically connected to the organic electroluminescent element, wherein a gate of the second transistor is electrically connected to a scan line, and wherein a gate of the sixth transistor is electrically connected to the scan line.

2. A display device comprising:

a pixel comprising:

a first transistor;

a second transistor;

a third transistor;

a fourth transistor;

a fifth transistor;

a sixth transistor;

a capacitor; and an organic electroluminescent element, wherein a gate of the first transistor is electrically connected to a first electrode of the capacitor, wherein one of a source and a drain of the second transistor is electrically connected to the gate of the first transistor, wherein the other of the source and the drain of the second transistor is directly connected to one of a source and a drain of the first transistor, wherein one of a source and a drain of the third transistor is electrically connected to a signal line, wherein the other of the source and the drain of the third transistor is electrically connected to the other of the source and the drain of the first transistor, wherein one of a source and a drain of the fourth transistor is electrically connected to a power supply line, wherein the other of the source and the drain of the fourth transistor is electrically connected to the one of the source and the drain of the first transistor, wherein one of a source and a drain of fifth transistor is electrically connected to the organic electroluminescent element, wherein the other of the source and the drain of the fifth transistor is electrically connected to the other of the source and the drain of the first transistor, wherein one of a source and a drain of the sixth transistor is electrically connected to the organic electroluminescent element, wherein a second electrode of the capacitor is electrically connected to the organic electroluminescent element, wherein a gate of the second transistor is electrically connected to a scan line, wherein a gate of the sixth transistor is electrically connected to the scan line, and wherein the second transistor comprises a channel formation region comprising an oxide semiconductor.

3. A display device comprising:

a pixel comprising:

a first transistor;

a second transistor;

a third transistor;

a fourth transistor;

a fifth transistor;

a sixth transistor;

a capacitor; and an organic electroluminescent element, wherein a gate of the first transistor is electrically connected to the capacitor, wherein one of a source and a drain of the second transistor is electrically connected to the gate of the first transistor, wherein the other of the source and the drain of the second transistor is directly connected to one of a source and a drain of the first transistor, wherein one of a source and a drain of the third transistor is electrically connected to a signal line, wherein the other of the source and the drain of the third transistor is electrically connected to the other of the source and the drain of the first transistor, wherein one of a source and a drain of the fourth transistor is electrically connected to a power supply line, wherein the other of the source and the drain of the fourth transistor is electrically connected to the one of the source and the drain of the first transistor, wherein one of a source and a drain of fifth transistor is electrically connected to the organic electroluminescent element, wherein the other of the source and the drain of the fifth transistor is electrically connected to the other of the source and the drain of the first transistor, wherein one of a source and a drain of the sixth transistor is electrically connected to the organic electroluminescent element, wherein a gate of the second transistor is electrically connected to a first scan line, wherein a gate of the third transistor is electrically connected to the first scan line, wherein a gate of the fourth transistor is electrically connected to a second scan line, and wherein a gate of the fifth transistor is electrically connected to the second scan line.

4. A display device comprising:

a pixel comprising:

a first transistor;

a second transistor;

a third transistor;

a fourth transistor;

a fifth transistor;

a sixth transistor;

a capacitor; and an organic electroluminescent element, wherein a gate of the first transistor is electrically connected to the capacitor, wherein one of a source and a drain of the second transistor is electrically connected to the gate of the first transistor, wherein the other of the source and the drain of the second transistor is directly connected to one of a source and a drain of the first transistor, wherein one of a source and a drain of the third transistor is electrically connected to a signal line, wherein the other of the source and the drain of the third transistor is electrically connected to the other of the source and the drain of the first transistor, wherein one of a source and a drain of the fourth transistor is electrically connected to a power supply line, wherein the other of the source and the drain of the fourth transistor is electrically connected to the one of the source and the drain of the first transistor, wherein one of a source and a drain of fifth transistor is electrically connected to the organic electroluminescent element, wherein the other of the source and the drain of the fifth transistor is electrically connected to the other of the source and the drain of the first transistor, wherein one of a source and a drain of the sixth transistor is electrically connected to the organic electroluminescent element, wherein a gate of the second transistor is electrically connected to a first scan line, wherein a gate of the third transistor is electrically connected to the first scan line, wherein a gate of the fourth transistor is electrically connected to a second scan line, wherein a gate of the fifth transistor is electrically connected to the second scan line, and wherein each of the first transistor, the second transistor, the third transistor, the fourth transistor, the fifth transistor and the sixth transistor comprises a channel formation region comprising silicon.

* * * * *